US010745845B2

(12) United States Patent
Yoneda et al.

(10) Patent No.: US 10,745,845 B2
(45) Date of Patent: Aug. 18, 2020

(54) DRUM WASHING MACHINE

(71) Applicants: QINGDAO HAIER WASHING MACHINE CO., LTD., Qingdao, Shandong (CN); AQUA CO., LTD, Chiyoda-ku, Tokyo (JP)

(72) Inventors: Masanori Yoneda, Tokyo (JP); Harumi Takeuchi, Tokyo (JP)

(73) Assignees: Qingdao Haier Washing Machine Co., Ltd., Shandong (CN); Aqua Co., Ltd., Tokyo (JP)

( * ) Notice: Subject to any disclaimer, the term of this patent is extended or adjusted under 35 U.S.C. 154(b) by 117 days.

(21) Appl. No.: 15/781,105

(22) PCT Filed: Nov. 29, 2016

(86) PCT No.: PCT/CN2016/107605
§ 371 (c)(1),
(2) Date: Jun. 1, 2018

(87) PCT Pub. No.: WO2017/092643
PCT Pub. Date: Jun. 8, 2017

(65) Prior Publication Data

US 2018/0347096 A1 Dec. 6, 2018

(30) Foreign Application Priority Data

Dec. 1, 2015 (JP) ..... 2015-234637

(51) Int. Cl.
*D06F 37/30* (2020.01)
*D06F 23/06* (2006.01)
(Continued)

(52) U.S. Cl.
CPC ..... *D06F 37/304* (2013.01); *D06F 23/06* (2013.01); *D06F 37/06* (2013.01); *D06F 37/40* (2013.01); *D06F 17/08* (2013.01)

(58) Field of Classification Search
CPC ..... D06F 17/08; D06F 37/304; D06F 7/40
See application file for complete search history.

(56) References Cited

FOREIGN PATENT DOCUMENTS

CN 2576758 Y 10/2003
CN 201924194 U 8/2011
(Continued)

OTHER PUBLICATIONS

CN105063965A Machine Translation (Year: 2015).*
(Continued)

*Primary Examiner* — Spencer E Bell
(74) *Attorney, Agent, or Firm* — Arent Fox LLP

(57) ABSTRACT

The present disclosure reduces sound generated when a driving mode of a drum washing machine having a rotating body on a rear part of a drum is switched between a first mode and a second mode. The first mode is a driving mode in which the drum and the rotating body independently rotate, and the second mode is a driving mode in which the drum and the rotating body integrally rotate. A bearing-side cushioning member is arranged on a clutch carrying plate side. The bearing-side cushioning member firstly touches an object side when a spline of a clutch body is engaged with a spline of the clutch carrying plate, so as to reduce an impact force generated between the clutch body and the clutch carrying plate.

4 Claims, 17 Drawing Sheets

(51) Int. Cl.

| | |
|---|---|
| ***D06F 37/40*** | (2006.01) |
| ***D06F 37/06*** | (2006.01) |
| ***D06F 17/08*** | (2006.01) |

(56) References Cited

FOREIGN PATENT DOCUMENTS

| | | | |
|---|---|---|---|
| CN | 102206913 | A | 10/2011 |
| CN | 105063965 | A | 11/2015 |
| JP | 06261997 | A | 9/1994 |
| JP | 2001157792 | A | 6/2001 |
| JP | 2015167663 | A | 9/2015 |
| WO | 2017092643 | A1 | 6/2017 |

OTHER PUBLICATIONS

Extended European Search Report received in European Patent Application No. 16869953 dated May 31, 2019.
International Search Report and Written Opinion for PCT/CN2016/107605 dated Mar. 9, 2017.

* cited by examiner

DRUM WASHING MACHINE

TECHNICAL FIELD

The present disclosure relates to a drum washing machine, which not only can be continuously operated from washing to drying, but also can carry out washing without drying.

BACKGROUND

In the past, in a drum washing machine, a transverse-shaft type drum is rotated in an outer drum which stores water at a bottom, washings are lifted up and dropped down by baffles arranged in the drum, and the washings are thrown to an inner circumferential surface of the drum to realize washing. In such a configuration in which the washings are stirred by the baffles, it is difficult for the washings to intertwine with each other or rub against each other. Therefore, with respect to the drum washing machine, in order to improve the cleaning performance, the following structure can be adopted: a stirring body is arranged on a rear surface of the drum, so that the drum and the stirring body can independently rotate at different rotating speeds during washing and rinsing.

During dewatering of the drum washing machine, the drum and the stirring body integrally rotate at the same rotating speed. Therefore, a clutch mechanism part for switching a driving mode between a first mode in which the drum and the stirring body independently rotate and a second mode in which the drum and the stirring body integrally rotate is arranged.

The drum and the stirring body are rotationally driven by a driving motor. A rotating shaft of the drum is connected with a planetary carrier of a planetary gear mechanism, and the rotation of the driving motor is transferred to the drum by virtue of the planetary gear mechanism. The clutch mechanism part includes a clutch body and a moving mechanism part. The clutch body is connected with an internal gear that forms the planetary gear mechanism in a manner that the clutch body cannot rotate relative to the internal gear. The moving mechanism part enables the clutch body to move between a driving motor side and a bearing unit side of the rotating shaft supporting the drum freely and rotationally. Splines are formed on the clutch body, at the rotor side end and at the bearing unit side end along a circumferential direction, and splines corresponding to the spline on the clutch body are formed on the rotor and the bearing unit.

The splines of the clutch body are engaged with the splines of the bearing unit in the first mode. Thus, the internal gear is fixed to the bearing unit by virtue of the clutch body in a manner that the internal gear cannot circumferentially rotate. When the rotor rotates in the state, the drum rotates independently of the stirring body at a rotating speed lower than that of the stirring body according to a reduction ratio of the planetary gear mechanism. In another aspect, the splines of the clutch body are engaged with the splines of the rotor in the second mode. Thus, the internal gear is fixed to the rotor by virtue of the clutch body. The drum integrally rotates with the stirring body at a rotating speed equal to that of the stirring body when the rotor rotates in this state.

The following condition may occur in the above drum washing machine: when the clutch body moves to the bearing unit side through the moving mechanism part, teeth of the splines of the clutch body and teeth of the splines of the bearing unit are abutted with each other rather than engaged. In this state, the clutch body is continuously pushed to the bearing unit side by the moving mechanism part. In this state, when the clutch body rotates through the internal gear along with the rotation of the rotor and a position of the tooth of the spline of the clutch body is shifted to a position not affected by the tooth of the spline of the bearing unit, the clutch body suddenly moves to the bearing unit side, so that the teeth of the splines are mutually engaged. However, impact sound which is harsh for a user may be generated between the clutch body and the bearing unit.

Similarly, when the clutch body moves to the rotor side through the moving mechanism part, teeth of the splines may also be abutted with each other rather than engaged. In this state, the clutch body is continuously pushed to the rotor side by the moving mechanism part. In this state, when a position of the tooth of the spline of the rotor is shifted to a position not affected by the tooth of the spline of the clutch body along with the rotation of the rotor, the clutch body suddenly moves to the rotor side, so that the teeth of the splines are mutually engaged. However, impact sound which is harsh for a user may be generated between the clutch body and the rotor.

SUMMARY

The present disclosure is completed in view of the above problems. A purpose of the present disclosure is as follows: for a drum washing machine with a rotating body on a rear part of a drum, sound generated when a driving mode is switched between a first mode in which the drum and the rotating body independently rotate and a second mode in which the drum and the rotating body integrally rotate.

A drum washing machine according to a first mode of the present disclosure includes: an outer drum arranged in a housing; a drum arranged in the outer drum and rotatable about a horizontal axis or an inclined axis inclined with respect to a horizontal direction; a rotating body arranged in a rear part of the drum, wherein a surface of the rotating body is provided with a baffle for contacting laundry; and a driving part configured to rotate the drum and the rotating body. The driving part includes: a driving motor; a first rotating shaft configured to transmit rotation of the driving motor to the rotating body; a second rotating shaft coaxially arranged with the first rotating shaft and configured to transmit the rotation of the driving motor to the drum; a planetary gear mechanism, including a sun gear rotating along with the rotation of the driving motor, an annular internal gear surrounding the sun gear, a plurality of planetary gears interposed between the sun gear and the internal gear, and a planetary carrier free rotatably holding the plurality of planetary gears, where one of the planetary carrier and the internal gear is fixed to the second rotating shaft; and a clutch mechanism part, configured to switch a driving mode of the driving part between a first mode and a second mode. The first mode is a driving mode in which the first rotating shaft and the second rotating shaft independently rotate, and the second mode is a driving mode in which the first rotating shaft and the second rotating shaft integrally rotate. The clutch mechanism part includes: a clutch body, connected to the other one of the planetary carrier and the internal gear in such a state that the clutch body is rotatable together with the other one of the planetary carrier and the internal gear and is moveable towards an axis direction of the second rotating shaft; a moving mechanism part, configured to enable the clutch body to move to a first position when switching to the first mode, and enable the clutch body to move to a second position when switching to the second mode; a first engaging part with a concave-convex shape and a second engaging part with a concave-convex shape formed in the clutch body; a first engaged part formed in a fixing part which does not rotate along with the driving motor, wherein the first engaged part has a concave-convex shape corresponding to the concave-convex shape of the first engaging part and is engaged with the first engaging part along a circumferential direction when the clutch body moves to the first position; a second engaged part formed in a rotating part which rotates along with the driving motor, where the second engaged part has a concave-convex shape corresponding to the concave-convex shape of the second engaging part and is engaged with the second engaging part along the circumferential direction when the clutch body moves to the second position; and a fixing part-side cushioning member is arranged on the clutch body side or the fixing part side. The fixing part-side cushioning member firstly touches an object side when the first engaging part and the first engaged part are engaged, so as to reduce an impact force generated between the clutch body and the fixing part.

When the clutch body is moved to the first position and the first engaging part and the first engaged part are engaged along the circumferential direction, the other party connected with the clutch body, such as the planetary carrier, does not rotate, and the driving mode is switched to the first mode. When the driving motor rotates, one party (such as the second rotating shaft connected with internal gear) rotates at a rotating speed different from the rotating speed of the first rotating shaft according to a reduction ratio of the planetary gear mechanism. Thus, the drum and the rotating body independently rotate at different rotating speeds.

In another aspect, when the clutch body is moved to the second position and the second engaging part and the second engaged part are engaged along the circumferential direction, the other party connected with the clutch body rotates along with the driving motor, and the driving mode is switched to the second mode. When the driving motor rotates, the second rotating shaft rotates at a rotating speed equal to the rotating speed of the first rotating shaft. Thus, the drum and the rotating body integrally rotate at the same rotating speed.

According to the above structure, the fixing part-side cushioning member provided on the clutch body side or the fixing part side firstly touches the object side when the first engaging part and the first engaged part are engaged, such that the impact force generated between the clutch body and the fixing part is reduced. Therefore, impact sound generated between the clutch body side and the fixing part side can be reduced.

In the drum washing machine in this mode, the driving part can also include a bearing part that free rotatably supports the second rotating shaft. In this case, the fixing part is mounted on the bearing part. The fixing part-side cushioning member is mounted on the fixing part side, and has a flange part sandwiched by the fixing part and the bearing part.

According to the above structure, the fixing part-side cushioning member is fixed to the fixing part side through the flange part which is clamped by the bearing part and the fixing part. Therefore, the fixing part-side cushioning member is easily fixed to the fixing part side.

In the drum washing machine in this mode, a rotating part-side cushioning member may be arranged on either the clutch body side or the rotating part side. The rotating part-side cushioning member firstly touches the object side when the second engaging part and the second engaged part are engaged, so as to reduce an impact force generated between the clutch body and the rotating part.

According to the above structure, the rotating part-side cushioning member arranged on the clutch body side or the rotating part side firstly touches the object side when the second engaging part and the second engaged part are engaged, and the impact force generated between the clutch body and the rotating part is weakened. Therefore, the impact sound generated between the clutch body side and the rotating part side can be reduced.

A drum washing machine in a second mode of the present disclosure includes: an outer drum arranged in a housing; a drum arranged in the outer drum and is rotatable about a horizontal axis or an inclined axis inclined with respect to a horizontal direction; a rotating body arranged in a rear part of the drum, wherein a surface of the rotating body is provided with a baffle for contacting laundry; and a driving part configured to rotate the drum and the rotating body. The driving part includes: a driving motor; a first rotating shaft configured to transmit rotation of the driving motor to the rotating body; a second rotating shaft coaxially arranged with the first rotating shaft and configured to transmit the rotation of the driving motor to the drum; a planetary gear mechanism, including a sun gear rotating along with the rotation of the driving motor, an annular internal gear surrounding the sun gear, a plurality of planetary gears interposed between the sun gear and the internal gear, and a planetary carrier free rotatably holding the plurality of planetary gears, where one of the planetary carrier and the internal gear is fixed to the second rotating shaft; and a clutch mechanism part, configured to switch a driving mode of the driving part between a first mode and a second mode. The first mode is a driving mode in which the first rotating shaft and the second rotating shaft independently rotate, and the second mode is a driving mode in which the first rotating shaft and the second rotating shaft integrally rotate. The clutch mechanism part includes: a clutch body, connected to the other one of the planetary carrier and the internal gear in such a state that the clutch body is rotatable together with the other one of the planetary carrier and the internal gear and is moveable towards an axis direction of the second rotating shaft; a moving mechanism part, configured to enable the clutch body to move to a first position when switching to the first mode, and enable the clutch body to move to a second position when switching to the second mode; a first engaging part with a concave-convex shape and a second engaging part with a concave-convex shape which are formed in the clutch body; a first engaged part which is formed in a fixing part that does not rotate along with the driving motor, wherein the first engaged part has a concave-convex shape corresponding to the concave-convex shape of the first engaging part and is engaged with the first engaging part along a circumferential direction when the clutch body moves to the first position; a second engaged part which is formed in a rotating part that rotates along with the driving motor, where the second engaged part has a concave-convex shape corresponding to the concave-convex shape of the second engaging part and is engaged with the second engaging part along the circumferential direction when the clutch body moves to the second position; and a rotating part-side cushioning member arranged on the clutch body side or the rotating part side. The rotating part-side cushioning member firstly touches an object side when the second engaging part and the second engaged part are engaged, so as to reduce an impact force generated between the clutch body and the rotating part.

According to the above structure, the impact sound generated between the clutch body side and the rotating part side can also be reduced like the drum washing machine in the first mode.

The drum washing machine in the first mode or the second mode can adopt the following structure: the rotating part-side cushioning member is arranged on the clutch body side and has a claw part, and the clutch body has a hole part for inserting and locking the claw part.

According to the above structure, the rotating part-side cushioning member is fixed to the clutch body side by locking the claw part of the rotating part-side cushioning member to the hole part of the clutch body. Therefore, the rotating part-side cushioning member can be easily fixed to the clutch body side.

According to the present disclosure, the sound generated when the driving mode is switched between the first mode in which the drum and the rotating body independently rotate and the second mode in which the drum and the rotating body integrally rotate.

Effects and significances of the present disclosure are further clarified by embodiments shown below. However, the following embodiments are merely examples for implementing the present disclosure, and the present disclosure is not limited by any content described in the following embodiments.

DETAILED DESCRIPTION

Hereinafter, a drum washing machine without a clothes drying function in an embodiment of the present disclosure is described by referring to drawings.

Figure 1:
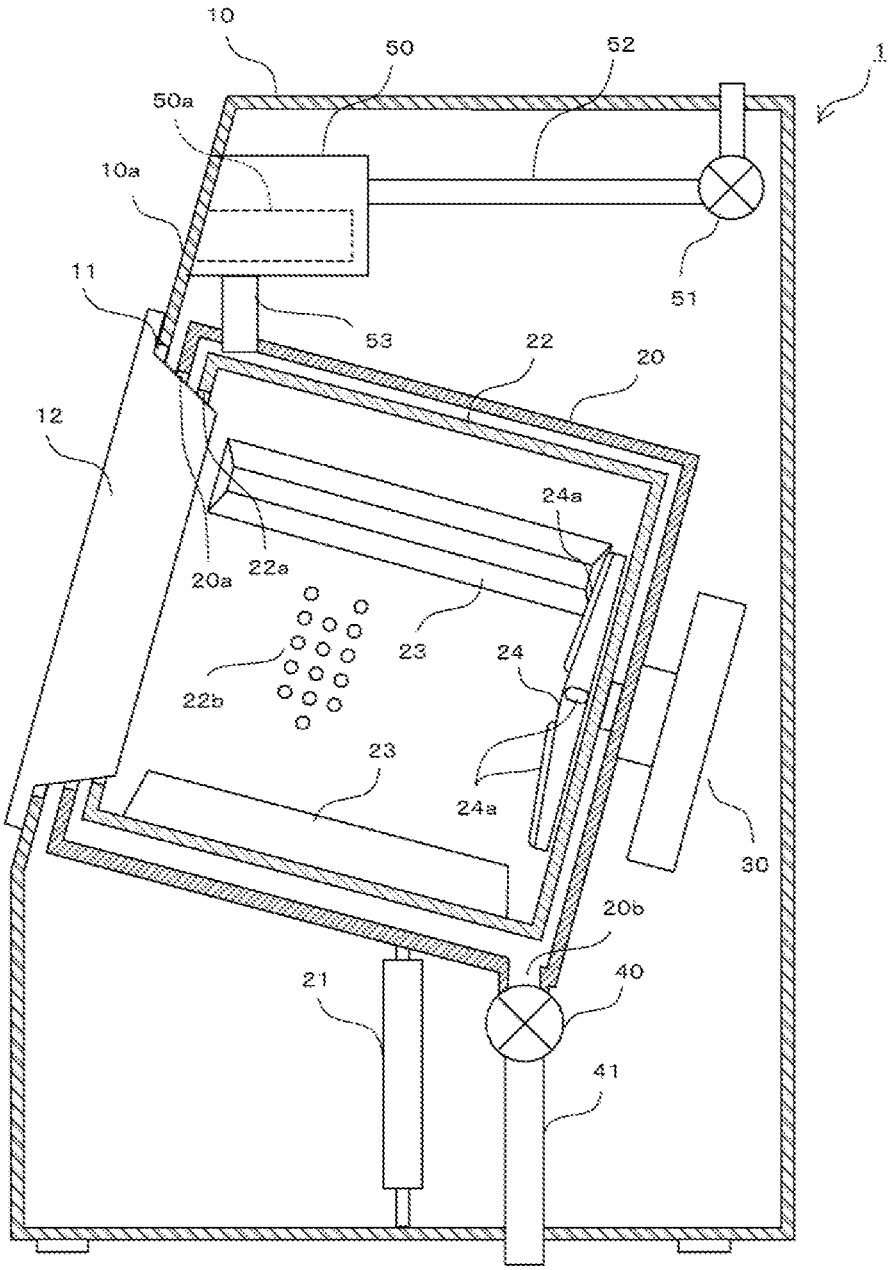
FIG. 1 is a side sectional view illustrating a structure of a drum washing machine involved in an embodiment.

FIG. 1 is a side sectional view illustrating a structure of a drum washing machine 1.

The drum washing machine 1 includes a housing 10 forming an appearance. A front surface 10*a* of the housing 10 is inclined from a central part to an upper part, and a laundry inlet 11 is formed in the inclined surface. The laundry inlet 11 is covered by a door 12 which is freely opened and closed.

In the housing 10, an outer drum 20 is elastically supported by a plurality of vibration dampers 21. A drum 22 is provided in the outer drum 20 in a free rotation manner. The outer drum 20 and the drum 22 are inclined in such a manner that rear surface sides thereof are lowered relative to a horizontal direction. Thus, the drum 22 rotates about an inclination axis inclined relative to the horizontal direction. Inclination angles of the outer drum 20 and the drum 22 may be set as about 10 degrees-20 degrees. An opening part 20*a* on the front surface of the outer drum 20 and an opening part 22*a* on the front surface of the drum 22 are opposed to the laundry inlet 11, and are opened and closed by the door 12, together with the laundry inlet 11. A plurality of dewatering holes 22*b* are formed in an inner circumferential surface of the drum 22. Further, three baffles 23 are arranged in the circumferential direction at substantially equal intervals on the inner circumferential surface of the drum 22.

A stirring body 24 is freely-rotatably disposed at the rear of the drum 22. The stirring body 24 has a substantially disc shape. A plurality of blades 24*a* that radially extend from the central part are formed on the surface of the stirring body 24. The stirring body 24 coaxially rotates with the drum 22. The stirring body 24 is equivalent to a rotating body in the present disclosure, and the blades 24*a* are equivalent to the baffles in the present disclosure.

A driving unit 30 capable of generating a torque for driving the drum 22 and the stirring body 24 is disposed behind the outer drum 20. The driving unit 30 is equivalent to a driving part in the present disclosure. The driving unit 30 enables the drum 22 and the stirring body 24 to rotate at different rotating speeds in the same direction in a washing process and a rinsing process. Specifically, the driving unit 30 enables the drum 22 to rotate at a rotating speed through which the centrifugal force applied to the laundry in the drum 22 is smaller than gravity, and enables the stirring body 24 to rotate at a rotating speed higher than the rotating speed of the drum 22. In another aspect, the driving unit 30 enables the drum 22 and the stirring body 24 to integrally rotate at a rotating speed through which the centrifugal force applied to the laundry in the drum 22 is much larger than the gravity in a dewatering process. A detailed structure of the driving unit 30 is described below.

A water outlet part 20*b* is formed in the bottom of the outer drum 20. A drainage valve 40 is provided in the water outlet part 20*b*. The drainage valve 40 is connected with a drainage hose 41. When the drainage valve 40 is opened, water stored in the outer drum 20 is discharged out of the machine by the drainage hose 41.

A detergent box 50 is provided on the front upper part of the housing 10. A detergent container 50*a* containing detergents is contained in the detergent box 50 in a free withdrawal manner. The detergent box 50 is connected with a water supply valve 51 provided on the upper rear part of the housing 10 via a soft water hose 52. In addition, the detergent box 50 is connected with the upper part of the outer drum 20 through a water filing pipe 53. When the water supply valve 51 is opened, running water from a faucet is supplied into the outer drum 20 by virtue of the soft water hose 52, the detergent box 50 and the water filing pipe 53. At this moment, the detergents contained in the detergent container 50*a* are supplied into the outer drum 20 along with a water flow.

Then, a structure of the driving unit 30 is described in detail.

Figure 2:
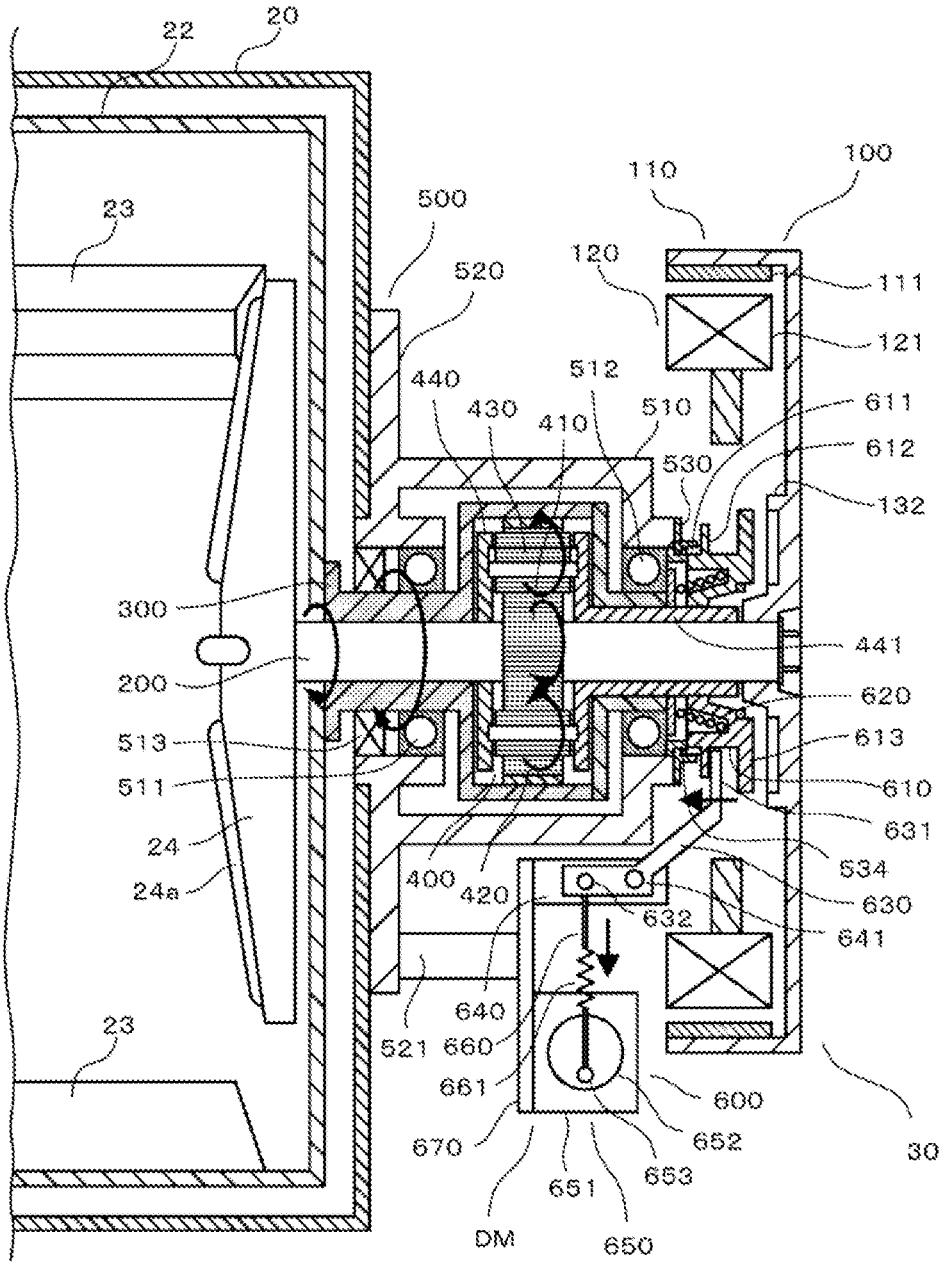
FIG. 2 is a sectional view illustrating a structure of a driving unit involved in an embodiment.
Figure 3:
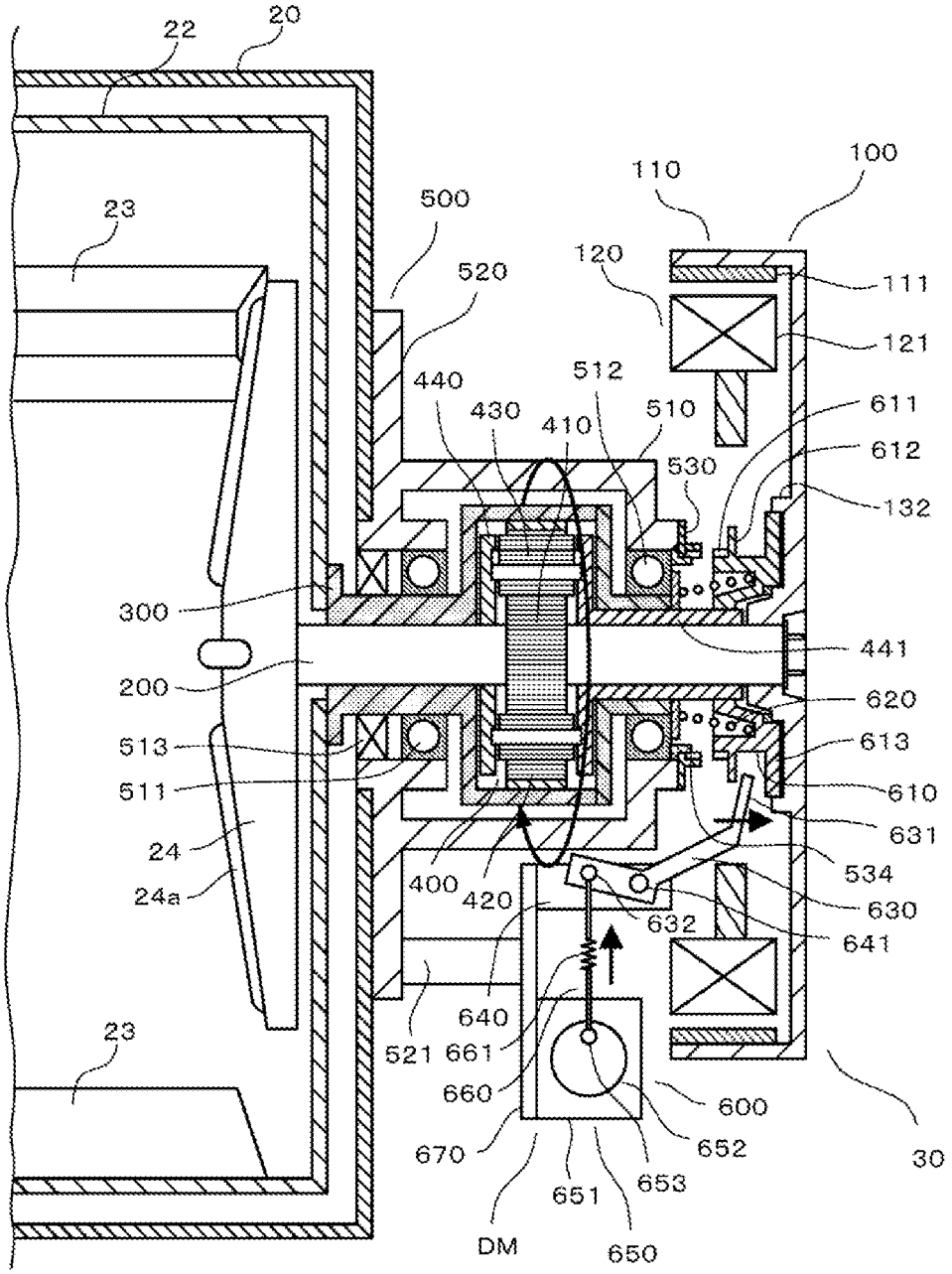
FIG. 3 is a sectional view illustrating a structure of a driving unit involved in an embodiment.
Figure 4:
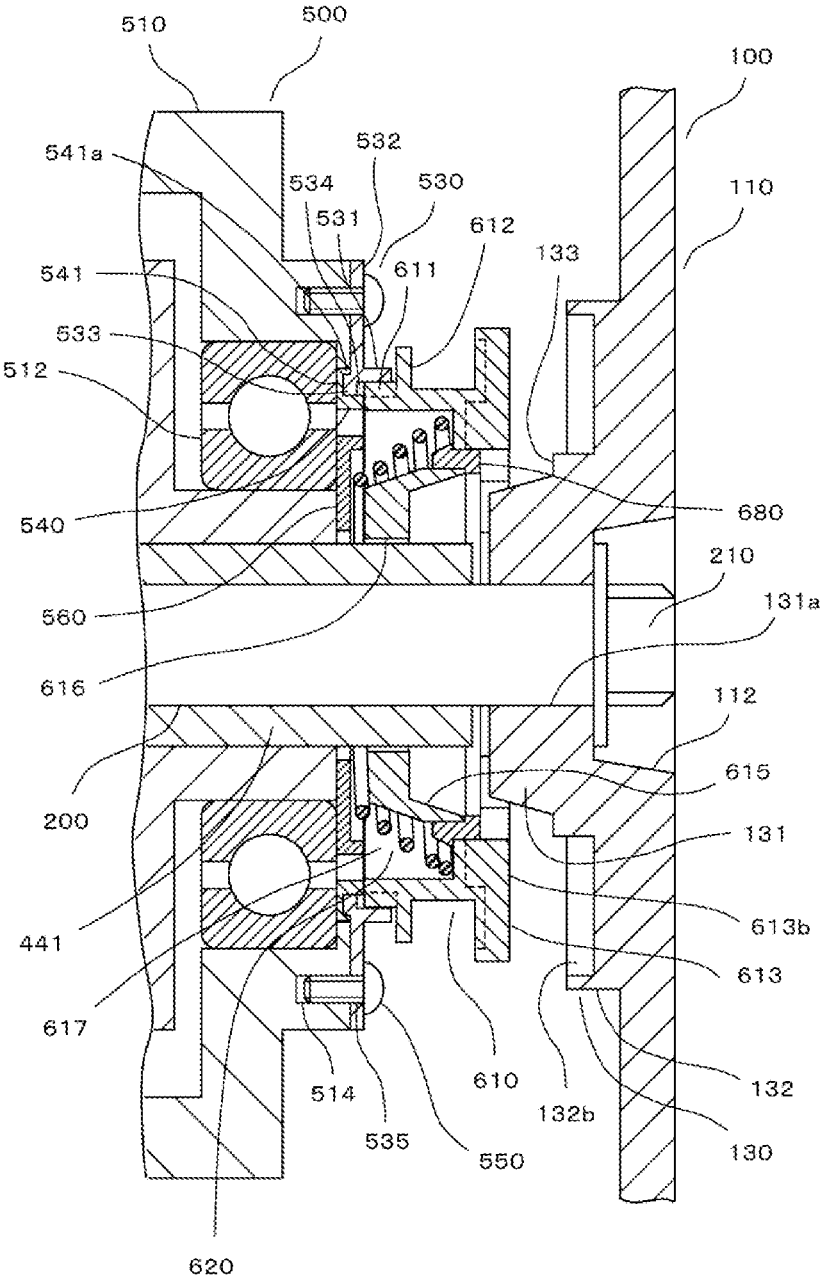
FIG. 4 is a sectional view illustrating an essential part enlarging a periphery of a clutch body involved in an embodiment.
Figure 5:
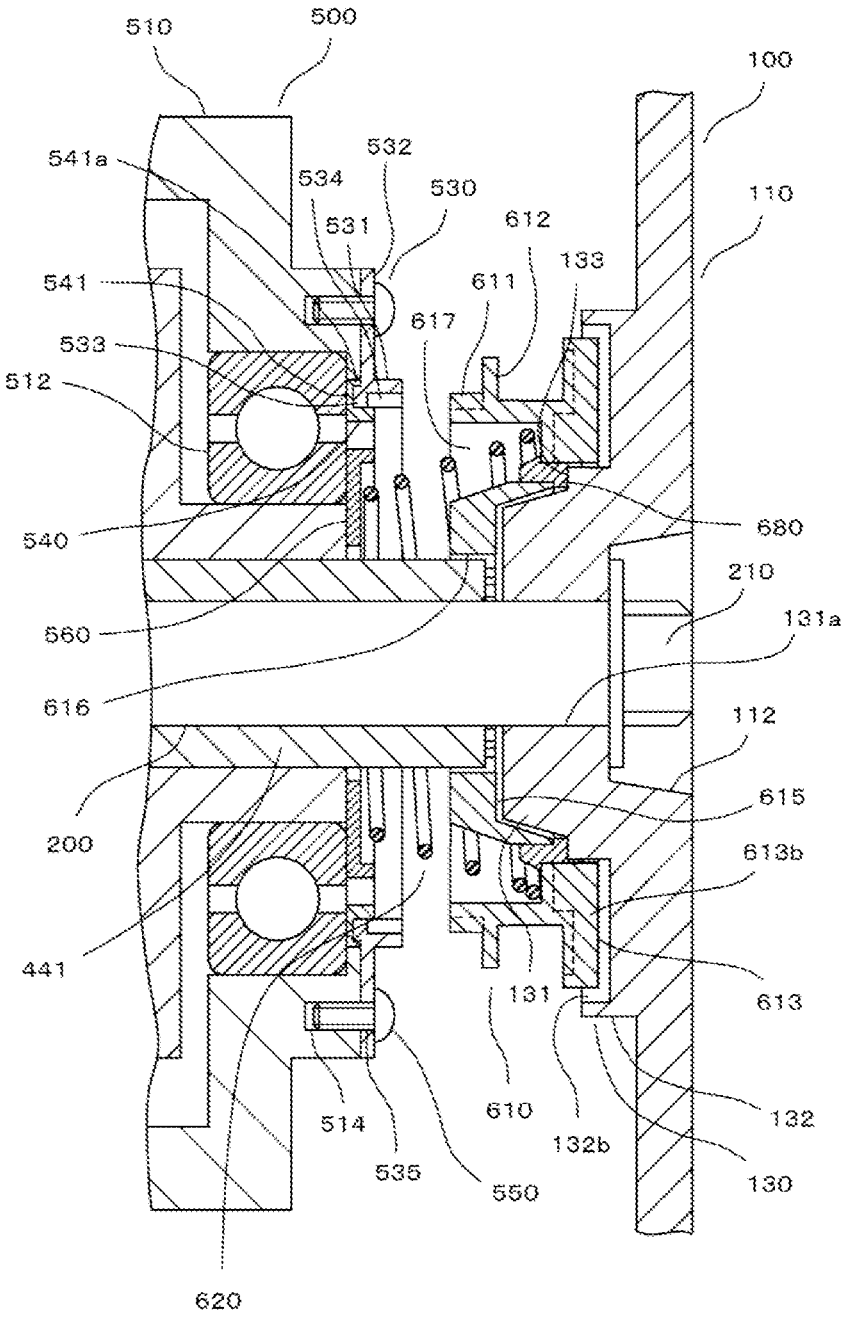
FIG. 5 is a sectional view illustrating an essential part enlarging a periphery of a clutch body involved in an embodiment.
Figure 6:
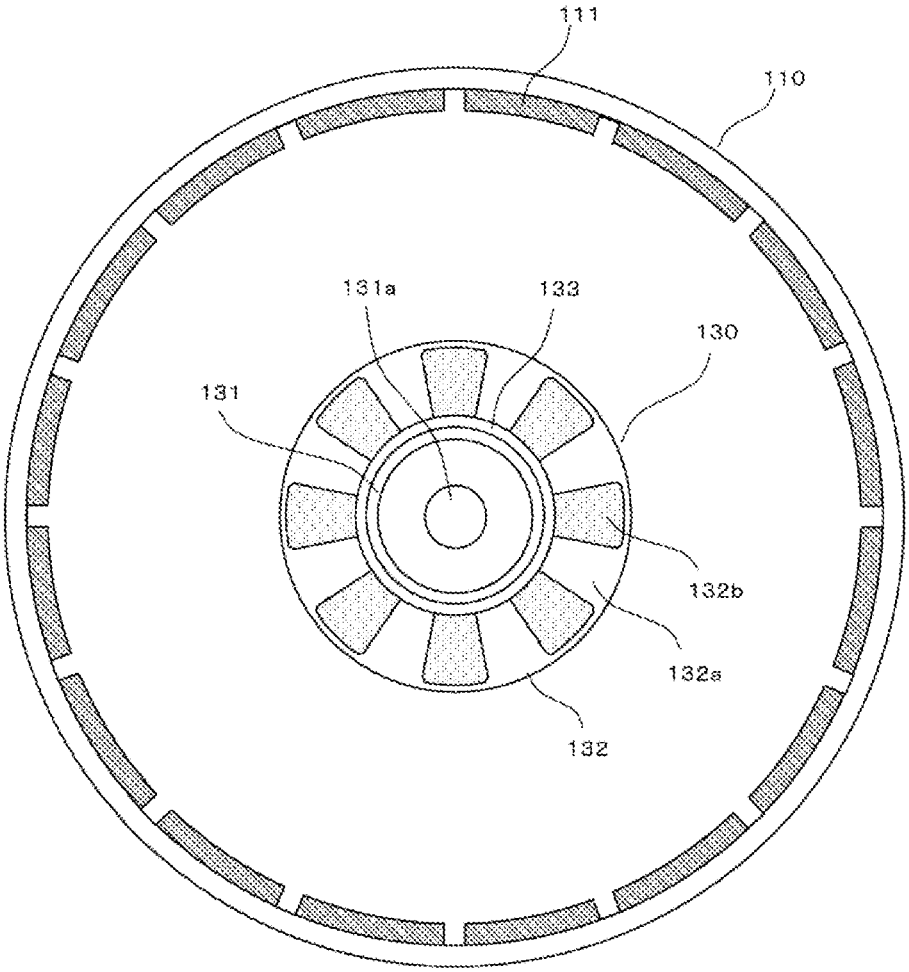
FIG. 6 is a front view illustrating a rotor of a driving motor involved in an embodiment.
Figure 7:
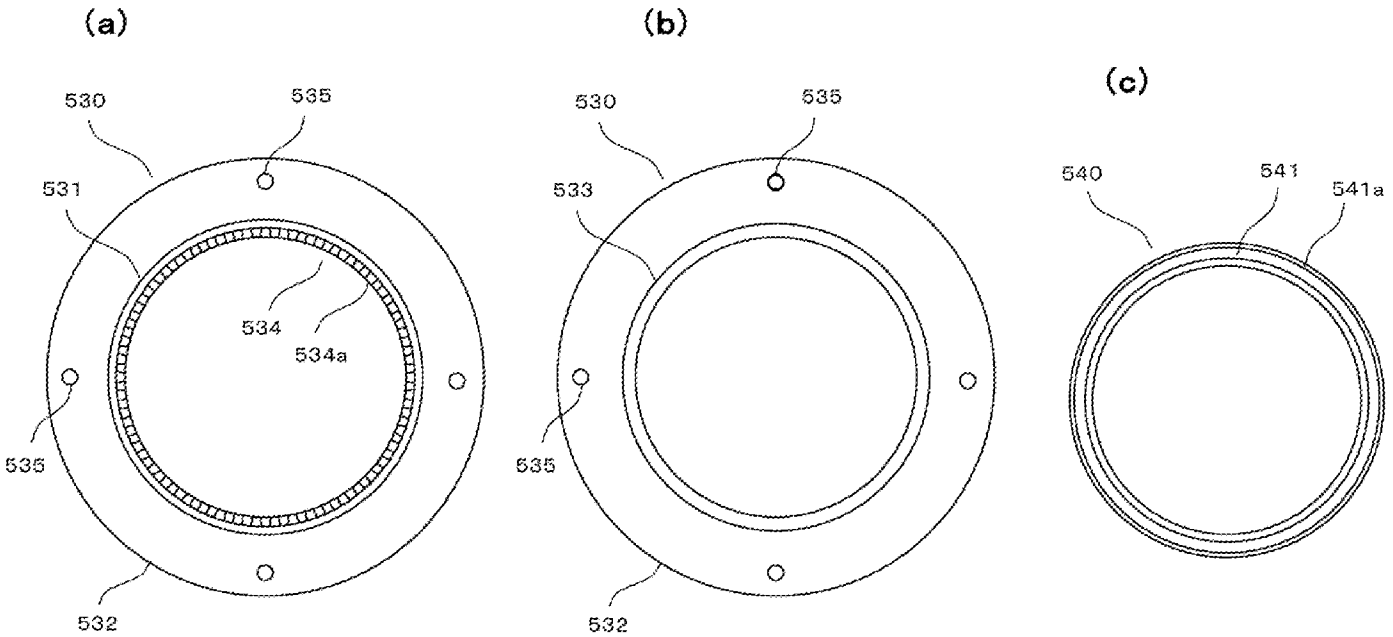
FIG. 7(*a*) and FIG. 7(*b*) are respectively a front view and a rear view illustrating a clutch carrying plate involved in an embodiment, and FIG. 7(*c*) is a front view illustrating a bearing-side cushioning member.
Figure 8:
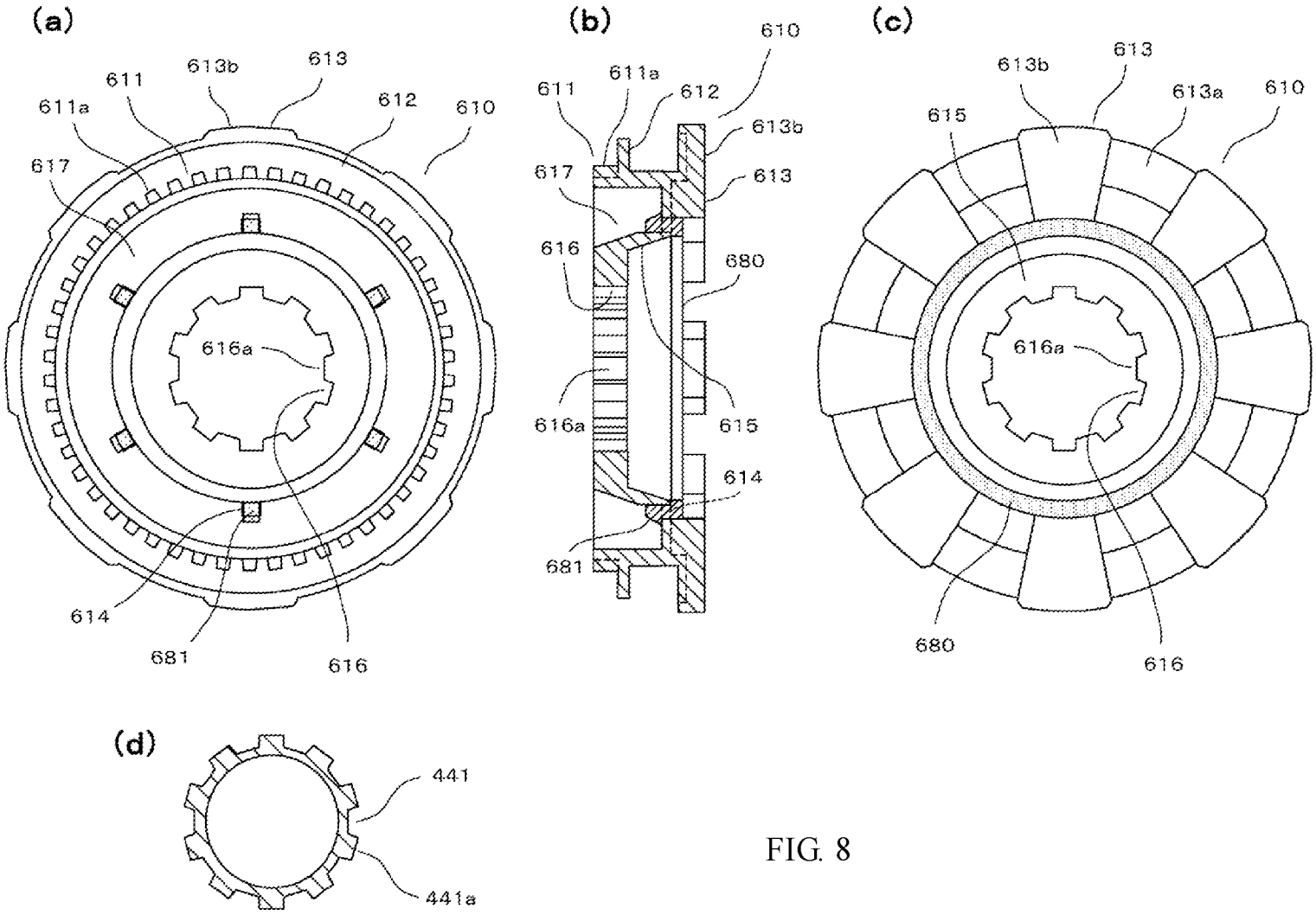
FIG. 8(*a*) to FIG. 8(*c*) are respectively a front view, a side longitudinal sectional view and a rear view illustrating a clutch body involved in an embodiment, and FIG. 8(*d*) is a sectional view illustrating a planetary carrier shaft involved in an embodiment.

FIG. 2 and FIG. 3 are sectional views illustrating a structure of a driving unit 30. FIG. 4 and FIG. 5 are sectional views illustrating an essential part enlarging a periphery of a clutch body 610. FIG. 2 and FIG. 4 show the driving unit 30 when a driving mode of the driving unit 30 is switched to a biaxial driving mode. FIG. 3 and FIG. 5 show the driving unit 30 when a driving mode of the driving unit 30 is switched to a uniaxial driving mode. FIG. 6 is front view illustrating a rotor 110 of a driving motor 100. FIG. 7(*a*) and FIG. 7(*b*) are a front view and a rear view illustrating a clutch carrying plate 530 respectively, and FIG. 7(*c*) is a front view illustrating a bearing-side cushioning member 540. FIG. 8(*a*) to FIG. 8(*c*) are a front view, a side longitudinal sectional view and a rear view illustrating a clutch body 610 respectively, and FIG. 8(*d*) is a sectional view illustrating a planetary carrier shaft 441. It should be noted that a clutch lever 630 is not shown in FIG. 4 and FIG. 5.

The driving unit 30 includes: a driving motor 100, a wing shaft 200, a drum shaft 300, a planetary gear mechanism 400, a bearing unit 500 and a clutch mechanism part 600. The driving motor 100 generates a torque for driving the stirring body 24 and the drum 22. The wing shaft 200 rotates through the torque of the driving motor 100, and transfers the rotation to the stirring body 24. The planetary gear mechanism 400 decelerates the rotation of the wing shaft 200 (i.e., the rotation of the rotor 110 of the driving motor 100) and transfers the rotation to the drum shaft 300. The drum shaft 300 rotates coaxially with the wing shaft 200 at the rotating speed reduced by the planetary gear mechanism 400, and transfers the rotation to the drum 22. The bearing unit 500 supports the wing shaft 200 and the drum shaft 300 in a free rotation manner. The clutch mechanism part 600 switches the driving mode of the driving unit 30 between the biaxial driving mode and the uniaxial driving mode. The biaxial driving mode is a driving mode that enables the stirring body 24 (i.e., the wing shaft 200) to rotate at a rotating speed equal to the rotating speed of the driving motor 100 and enables the drum 22 (i.e., the drum shaft 300) to rotate at a rotating speed reduced by the planetary gear mechanism 400. The uniaxial driving mode is a driving mode that enables the stirring body 24 and the drum 22 (i.e., the wing shaft 200), as well as the drum shaft 300 and the planetary gear mechanism 400 to integrally rotate at a rotating speed equal to the rotating speed of the driving motor 100. The wing shaft 200 corresponds to a first rotating shaft in the present disclosure, and the drum shaft 300 corresponds to a second rotating shaft in the present disclosure. The biaxial driving mode corresponds to a first mode in the present disclosure, and the uniaxial driving mode corresponds to a second mode in the present disclosure.

The driving motor 100 is an outer rotor type DC brushless motor and includes a rotor 110 and a stator 120. The rotor 110 is formed in a bottomed cylinder shape and made from reinforced resin which is formed by mixing reinforcing materials such as glass in resin, and permanent magnets 111 are arranged throughout the entire circumference on the inner circumferential surface of the rotor 110. As shown in FIG. 4, FIG. 5 and FIG. 6, a clutch carrying part 130 is integrally formed with the rotor 110 on a central part of the rotor 110. The clutch carrying part 130 and the driving motor 100 (i.e., the rotor 110) are rotated together.

The clutch carrying part 130 includes a lug boss part 131, an engaged part 132 and a touch surface 133. The lug boss part 131 has a substantially trapezoidal cross section and a lug boss hole 131*a* in the central part. The wing shaft 200 extends through the lug boss hole 131*a*. The lug boss hole 131*a* is communicated with a recess 112 formed in a central of a rear surface of the rotor 110. The engaged part 132 is formed at a periphery of the lug boss part 131, and has a substantially annular shape. A plurality of engaging recesses 132*b* recessed towards a side deeper than the surface 132*a* of the engaged part 132 are formed along the circumferential direction at substantially equal intervals on the engaged part 132. In this way, a concave-convex shape is formed along the circumferential direction on the engaged part 132 through the surface 132*a* and the engaging recesses 132*b*. The touch surface 133 is arranged between the lug boss part 131 and the engaged part 132, and has a flat surface protruded by a section from the surface 132*a* of the engaged part 132. The clutch carrying part 130 corresponds to a rotating part in the present disclosure, and the engaged part 132 corresponds to a second engaged part in the present disclosure.

A coil 121 is arranged on an outer circumferential part of the stator 120. When a driving current is supplied to the coil 121 of the stator 120 from an after-mentioned motor driving part, the rotor 110 rotates.

The drum shaft 300 is of a hollow shape and encloses the wing shaft 200 and the planetary gear mechanism 400. The central part of the drum shaft 300 is bulged outwards. The bulged part forms a containing part of the planetary gear mechanism 400.

The planetary gear mechanism 400 includes: a sun gear 410, an annular internal gear 420 surrounding the sun gear 410, a plurality of groups of planetary gears 430 between the sun gear 410 and the internal gear 420, and a planetary carrier 440 holding the planetary gears 430 in a free rotation manner.

The sun gear 410 is fixed to the wing shaft 200, and is rotated with the rotation of the driving motor 100. The internal gear 420 is fixed to the drum shaft 300. A group of planetary gears 430 includes a first gear and a second gear which are engaged mutually and rotated in opposed directions. The planetary carrier 440 includes a planetary carrier shaft 441 extending backwards. The planetary carrier shaft 441 is coaxial with the drum shaft 300, and is internally hollowed to insert the wing shaft 200.

A rear end part of the wing shaft 200 is protruded backwards from the planetary carrier shaft 441, and is fixed to the lug boss hole 131*a* of the rotor 110 through an installing bolt 210. A head of the installing bolt 210 is accommodated in the recess 112 of the rotor 110, and is not further protruded backwards than the rotor 110.

A cylindrical bearing part 510 is arranged on the central part of the bearing unit 500. In the bearing part 510, rolling bears 511 and 512 are arranged on the front portion and on the rear portion respectively. A mechanical seal 513 is arranged on the front end part. An outer circumferential surface of the drum shaft 300 is carried by the rolling bears 511 and 512, and rotates smoothly in the bearing part 510. In addition, the mechanical seal 513 is used to prevent water from entering a place between the bearing part 510 and the drum shaft 300.

A fixing flange part 520 is formed around the bearing part 510 of the bearing unit 500. An installing lug boss 521 is formed on a lower end part of the fixing flange part 520.

A clutch carrying plate 530 is installed on a rear end part of the bearing part 510. As shown in FIG. 4, FIG. 5 and FIG. 7(*a*) and FIG. 7(*b*), the clutch carrying plate 530 is made of reinforced resin that is same as the reinforced resin of the rotor 110, and includes a carrying body part 531, a flange part 532 and a pressing part 533. The carrying body part 531 is formed in a flat cylindrical shape, and has a spline 534 on an inner side surface. Each tooth 534*a* of the spline 534 is formed along the circumferential direction of the carrying body part 531 at substantially equal intervals, and is protruded to an inner side of the carrying body part 531. The flange part 532 is formed on an outer circumferential surface of the carrying body part 531 and has a circular shape. Inserting through holes 535 through which screws 550 go are formed in multiple positions of the flange part 532. The pressing part 533 is protruded from the carrying body part 531 to the rolling bearing 512, and has a circular shape. The clutch carrying plate 530 corresponds to a fixing part in the present disclosure, and the spline 534 corresponds to the first engaged part in the present disclosure.

The clutch carrying plate 530 is fixed to a rear end part of the bearing part 510 through the screw 550. The screw 550 goes through the inserting through hole 535 and is fastened to a screw hole 514 formed at the rear end part of the bearing part 510.

A bearing-side cushioning member 540 is provided at an inner circumferential side of the carrying body part 531 of the clutch carrying plate 530. As shown in FIG. 4, FIG. 5 and FIG. 7(*c*), the bearing-side cushioning member 540 has a flat cylindrical shape, and is made of rubber or other elastic materials. The bearing-side cushioning member 540 corresponds to the fixed part side cushioning member in the present disclosure. The bearing-side cushioning member 540 has a circular flange part 541. The flange part 541 is sandwiched between the rolling bearing 512 of the bearing part 510 and the pressing part 533 of the clutch carrying plate 530, and is pressed to the rolling bearing 512 side by the pressing part 533. Thus, the bearing-side cushioning member 540 is fixed to the clutch carrying plate 530 side. The outer circumferential edge of the flange part 541 is provided with an annular protruding part 541*a*, and the protruding part 541*a* comes into contact with the outer circumferential surface of the pressing part 533 so that the flange part 541 is less likely to come off a part between the rolling bearing 512 and the pressing part 533. Further, a spring carrying part 560 is arranged behind the rolling bearing 512 and at the inner side of the bearing-side cushioning member 540.

The bearing unit 500 is fixed to a rear surface of the outer drum 20 via the fixing flange part 520 through fixing methods such as screw fastening. In a state that the driving unit 30 is mounted on the outer drum 20, the wing shaft 200 and the drum shaft 300 enter the outer drum 20. The drum 22 is fixed to the drum shaft 300, and the stirring body 24 is fixed to the wing shaft 200.

The clutch mechanism part 600 includes: a clutch body 610, a clutch spring 620, a clutch lever 630, a lever supporting part 640, a clutch driving apparatus 650, a relay rod 660 and an installing plate 670. The clutch spring 620, the clutch lever 630, the lever supporting part 640, the clutch driving apparatus 650 and the relay rod 660 form a moving mechanism part DM that moves the clutch body 610.

As shown in FIG. 4, FIG. 5 and FIG. 8(*a*)-FIG. 8(*c*), the clutch body 610 is made of the reinforced resin identical with the reinforced resin of the rotor 110, and has a substantially disc shape. An annular spline 611 is formed on an outer circumferential surface at a front end part of the clutch body 610. Teeth 611*a* of the spline 611 are formed along the circumferential direction of the clutch body 610 at substantially equal intervals, and each are protruded towards the outer side of the clutch body 610. The spline 611 corresponds to the first engaging part in the present disclosure. In addition, a flange part 612 is formed on the outer circumferential surface of the clutch body 610 and behind the spline 611.

An engaging part 613 is formed at a rear end part of the clutch body 610. The engaging part 613 has a circular base surface 613*a*, and a plurality of engaging protrusions 613*b* that protrude backwards are formed along the circumferential direction on the base surface 613*a* at substantially equal intervals. The engaging protrusions 613*b* have substantially the same shape as the engaging recesses 132*b* of the engaged part 132. In this way, the engaging part 613 has a concave-convex shape along the circumferential direction through the base surface 613*a* and the engaging protrusions 613*b*. Further, the rear end part of the clutch body 610 is provided with a rotor-side cushioning member 680 at the inner side of the engaging part 613. The rotor-side cushioning member 680 is made of elastic materials such as rubber, and has a circular shape. The rotor-side cushioning member 680 is provided with a claw part 681 formed at multiple places on a depth direction side. The claw part 681 of the rotor-side cushioning member 680 is inserted into a hole part 614 formed in the rear end part of the clutch body 610 so that a tip end part of the claw part 681 is locked to the depth direction side of the hole part 614 and then fixed to the clutch body 610. The engaging part 613 corresponds to the second engaging part in the present disclosure, and the rotor-side cushioning member 680 corresponds to the rotating part-side cushioning member in the present disclosure.

In the clutch body 610, in order to prevent the clutch body 610 from hitting the lug boss part 131 of the clutch carrying part 130, a truncated cone-shaped recess 615 is formed at the inner side of the rotor-side cushioning member 680. In addition, a shaft hole 616 that extends from the front end part of the clutch body 610 to the recess 615 is formed at the center of the clutch body 610. A spline 616*a* is formed at the shaft hole 616. In another aspect, as shown in FIG. 8(*d*), a spline 441*a* corresponding to the spline 616*a* is formed on the planetary carrier shaft 441. When the planetary carrier shaft 441 is inserted into the shaft hole 616, the spline 616*a* is engaged with the spline 441*a*. Thus, the clutch body 610 is in a state that the clutch body 610 can move in a front-rear direction relative to the planetary carrier shaft 441 but cannot rotate in the circumferential direction.

An annular accommodation groove 617 is formed in outside the shaft hole 616 of the clutch body 610. The accommodation groove 617 contains a clutch spring 620. One end of the clutch spring 620 is received by the spring receiving part 560, and the other end is received by a bottom surface of the accommodation groove 617.

The clutch lever 630 is supported by a supporting shaft 641 arranged on a level supporting part 640 in a free rotation manner. On an upper end part of the clutch lever 630, a pressing part 631 contacting a rear surface of the flange part 612 of the clutch body 610 and configured to push the flange part 612 forwards is formed. In addition, an installing shaft 632 is formed at a lower end part of the clutch lever 630.

The clutch driving apparatus 650 is provided below the clutch lever 630. The clutch driving apparatus 650 includes a torque motor 651 and a disc-shaped cam 652 which is rotated about a horizontal axis by a torque of the torque motor 651. At an upper surface of the cam 652, a camshaft 653 is arranged at an outer circumferential part. A rotation center of the cam 652 and a center of the installing shaft 632 of the clutch lever 630 aligned in the front-rear direction.

The relay rod 660 extends in a vertical direction and connects the clutch lever 630 and the cam 652. An upper end part of the relay rod 660 is mounted to the installing shaft 632 of the clutch lever 630, and a lower end part is mounted to the camshaft 653 of the cam 652. A spring 661 is integrally formed with the relay rod 660 in a middle position of the relay rod 660. The spring 661 is a tension spring.

The lever supporting part 640 and the clutch driving apparatus 650 are secured to the installing plate 670 through securing methods such as screw fastening. The installing plate 670 is fixed to an installing lug boss 521 of the bearing unit 500 through a screw.

When the driving mode of the driving unit 30 is switched from the uniaxial driving mode to the biaxial driving mode, as shown in FIG. 2, the cam 652 is rotated through the operation of the torque motor 651 in such a manner that the camshaft 653 is located at a lowermost part. With the rotation of the cam 652, the lower end part of the clutch lever 630 is pulled downward by the relay rod 660. The clutch lever 630 rotates forwards about the supporting shaft 641. The pressing part 631 pushes the clutch body 610 forwards. The clutch body 610 to moves forward against the elastic force of the clutch spring 620. The spline 611 of the clutch body 610 and the spline 503 of the clutch carrying plate 530 are engaged along the circumferential direction.

When the camshaft 653 moves to a predetermined intermediate position, the spline 611 of the clutch body 610 reaches a position where the spline 611 and the spline 534 are engaged. At this moment, the spring 661 of the relay rod 660 is in a state of natural length. Since the clutch body 610 does not move to a position in front of the engaging position, when the camshaft 653 moves from the predetermined position to the lowermost position, as shown in FIG. 2, the spring 661 extends downward. In this way, since the clutch lever 630 is pulled by the spring 661 and moves forward, a pressing force is applied by the pressing part 631 to the clutch body 610 in the engaging position. Thus, the spline 611 and the spline 534 are firmly engaged.

When the spline 611 and the spline 534 are engaged, since the clutch body 610 is in a state that the clutch body 610 cannot rotate relative to the bearing unit 500, the planetary carrier shaft 441 of the planetary gear mechanism 400, i.e., the planetary carrier 440 is fixed and cannot rotate. In this state, when the rotor 110 rotates, the wing shaft 200 rotates at a same rotating speed as that of the rotor 110, and the stirring body 24 connected with the wing shaft 200 also rotates at a same rotating speed as that of the rotor 110. For the planetary gear mechanism 400, the sun gear 410 rotates with the rotation of the wing shaft 200. As mentioned above, since the planetary carrier 440 is fixed, a first gear and a second gear of the planetary gear 430 respectively rotate in a same direction and a reverse direction as the sun gear 410, and the internal gear 420 rotates in a same direction as the sun gear 410. Thus, the drum shaft 300 fixed to the internal gear 420 rotates in the same direction as the wing shaft 200 at a rotating speed lower than that of the wing shaft 200, and the drum 22 fixed to the drum shaft 300 rotates in the same direction as the stirring body 24 at a rotating speed lower than that of the stirring body 24. In other words, the stirring body 24 rotates in the same direction as the drum 22 at a rotating speed higher than that of the drum 22.

In another aspect, when the driving mode of the driving unit 30 is switched from the biaxial driving mode to the uniaxial driving mode, as shown in FIG. 3, the cam 652 is rotated through the operation of the torque motor 651 in such a manner that the camshaft 653 is located at an uppermost part. When the cam 652 rotates and the camshaft 653 moves upwards, the spring 661 is contracted first. When the spring 661 returns to the natural length, then with the movement of the camshaft 653, the relay rod 660 moves upwards, and the lower end part of the clutch lever 630 is pushed by the relay rod 660 and moves upwards. The clutch lever 630 rotates backwards about the supporting shaft 641, and the pressing part 631 leaves the flange part 612 of the clutch body 610. The clutch body 610 moves backwards through the elastic force of the clutch spring 620, and the engaging part 613 of the clutch body 610 and the engaged part 132 of the clutch carrying part 130 are engaged along the circumferential direction.

When the engaging part 613 and the engaged part 132 are engaged, the clutch body 610 can rotate together with the rotor 110. In this state, when the rotor 110 rotates, the wing shaft 200 and the clutch body 610 rotate at a same rotating speed as that of the rotor 110. At this moment, for the planetary gear mechanism 400, the sun gear 410 and the planetary carrier 440 rotate at a same rotating speed as that of the rotor 110. Thus, the internal gear 420 rotates at a same rotating speed as that of the sun gear 410 and the planetary carrier 440, and the drum shaft 300 fixed to the internal gear 420 rotates at a same rotating speed as that of the rotor 110. Namely, in the driving unit 30, the wing shaft 200, the planetary gear mechanism 400 and the drum shaft 300 integrally rotate. Thus, the drum 22 and the stirring body 24 integrally rotate.

Figure 9:
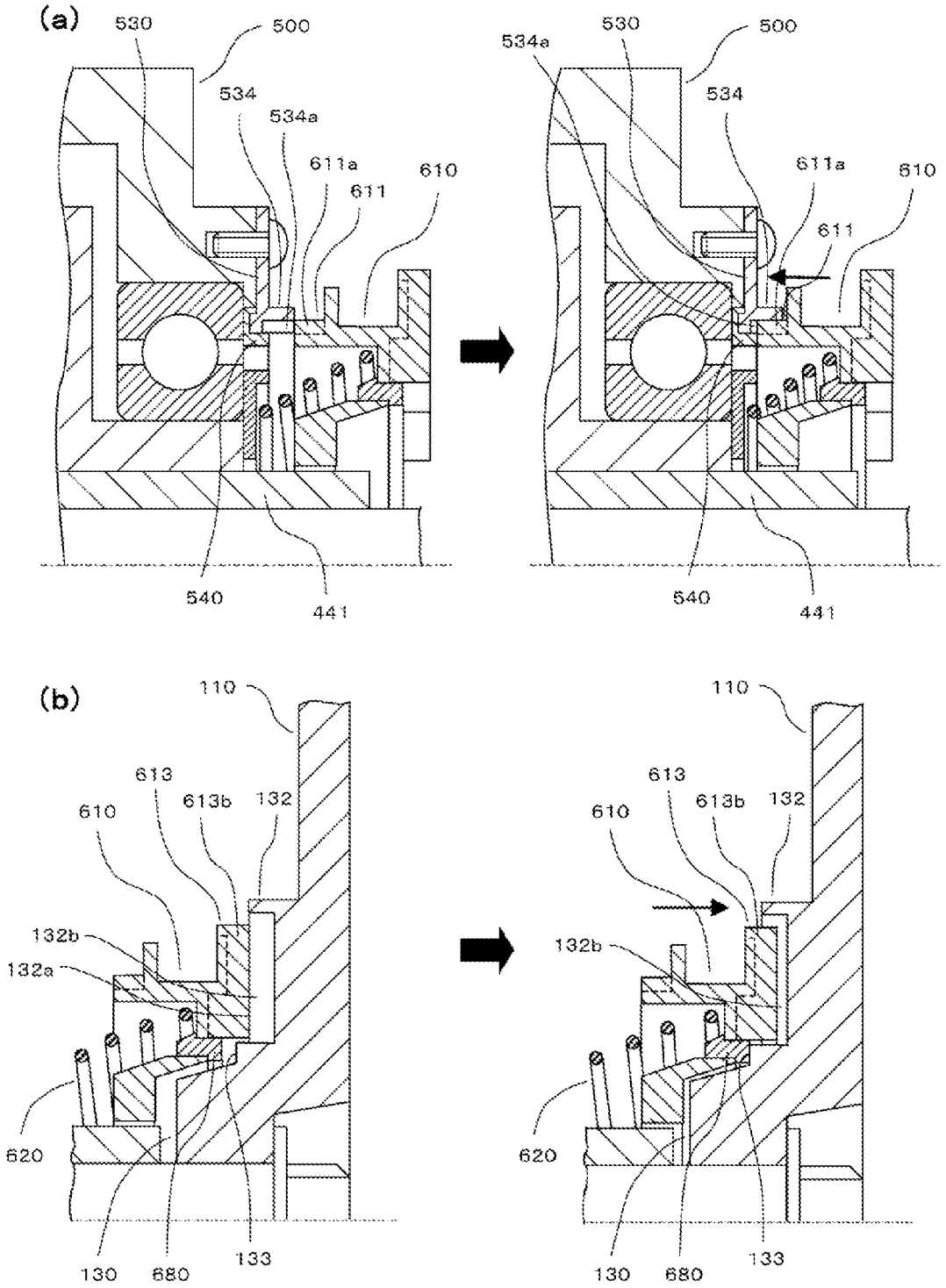
FIG. 9(*a*) is a state transition diagram illustrating an engagement state of a spline of a clutch body and a spline of a clutch carrying plate when switching from a uniaxial driving mode to a biaxial driving mode involved in an embodiment, and FIG. 9(*b*) is a state transition diagram illustrating an engagement state of an engaging part of a clutch body and an engaged part of a clutch carrying part when switching from a biaxial driving mode to a uniaxial driving mode involved in an embodiment.

FIG. 9(*a*) is a state transition diagram illustrating an engagement state of the spline 611 of the clutch body 610 and the spline 534 of the clutch carrying plate 530 when switching from the uniaxial driving mode to the biaxial driving mode, and FIG. 9(*b*) is a state transition diagram illustrating an engagement state of the engaging part 613 of the clutch body 610 and the engaged part 132 of the clutch carrying part 130 when switching from the biaxial driving mode to the uniaxial driving mode.

When the clutch body 610 moves to the clutch carrying plate 530 side of the bearing unit 500 in order to switch to the biaxial driving mode, as shown in the left figure in FIG. 9(*a*), there is a possibility that teeth 611*a* of the spline 611 and teeth 534*a* of the spline 534 may be not engaged and abut each other. In this state, as mentioned above, the clutch body 610 is continuously pushed by the clutch lever 630 to the clutch carrying plate 530 side. Moreover, in this state, as the rotor 110 rotates, due to the connection with the drum 22, the internal gear 420 with a large load applied does not rotate, while the planetary carrier 440 with a small load applied rotates, and the clutch body 610 rotates through the planetary carrier shaft 441. When the teeth 611*a* of the spline 611 of the clutch body 610 is moved through the rotation of the clutch body 610 to a position where the teeth 611*a* of the spline 611 are not obstructed by the teeth 534*a* of the spline 534 of the clutch carrying plate 530, as shown in the right figure of FIG. 9(*a*), the clutch body 610 rapidly moves to the clutch carrying plate 530 side, and the teeth 611*a* and 534*a* are mutually engaged. At this moment, since the bearing-side cushioning member 540 provided on the clutch carrying plate 530 side firstly comes into contact with the front end part of the clutch body 610 on an object side, the impact force to the clutch carrying plate 530 side of the clutch body 610 is absorbed by the bearing-side cushioning member 540 and is weakened. Thus, an impact sound generated between the clutch body 610 side and the clutch carrying plate 530 side is reduced.

Similarly, when the clutch body 610 moves to the clutch carrying part 130 side of the rotor 110 in order to switch to the uniaxial driving mode, as shown in the left figure in FIG. 9(*b*), the engaging protrusion 613*b* of the engaging part 613 and the engaging recess 132*b* of the engaged part 132 may be not engaged, and the engaging protrusion 613*b* may be abutted against the surface 132*a* of the engaged part 132. In this state, as mentioned above, the clutch body 610 is continuously pushed by the clutch spring 620 to the clutch carrying part 130 side. In this state, as the rotor 110 rotates, when the engaging recess 132*b* of the engaged part 132 is staggered to a position where the engaging recess 132*b* is consistent with the engaging protrusion 613*b* of the engaging part 613, as shown in the right figure of FIG. 9(*b*), the clutch body 610 rapidly moves to the clutch carrying part 130 side, and the engaging protrusion 613*b* is engaged with the engaging recess 132*b*. At this moment, since the rotor-side cushioning member 680 provided on the clutch body 610 side firstly comes into contact with the touch surface 133 of clutch carrying part 130, the impact force to the clutch carrying part 130 side of the clutch body 610 is absorbed by the rotor-side cushioning member 680 and is weakened. Thus, an impact sound generated between the clutch body 610 side and the clutch carrying part 130 side is reduced.

It should be noted that the rotor 110, the clutch carrying plate 530 and the clutch body 610 are all made of the reinforced resin. Therefore, if the bearing-side cushioning member 540 and the rotor-side cushioning member 680 which are harder than ordinary resin are not arranged, the impact sound between the clutch body 610 side and the clutch carrying plate 530 and the impact sound between the clutch body 610 side and the clutch carrying part 130 side are especially easy to increase.

Figure 10:
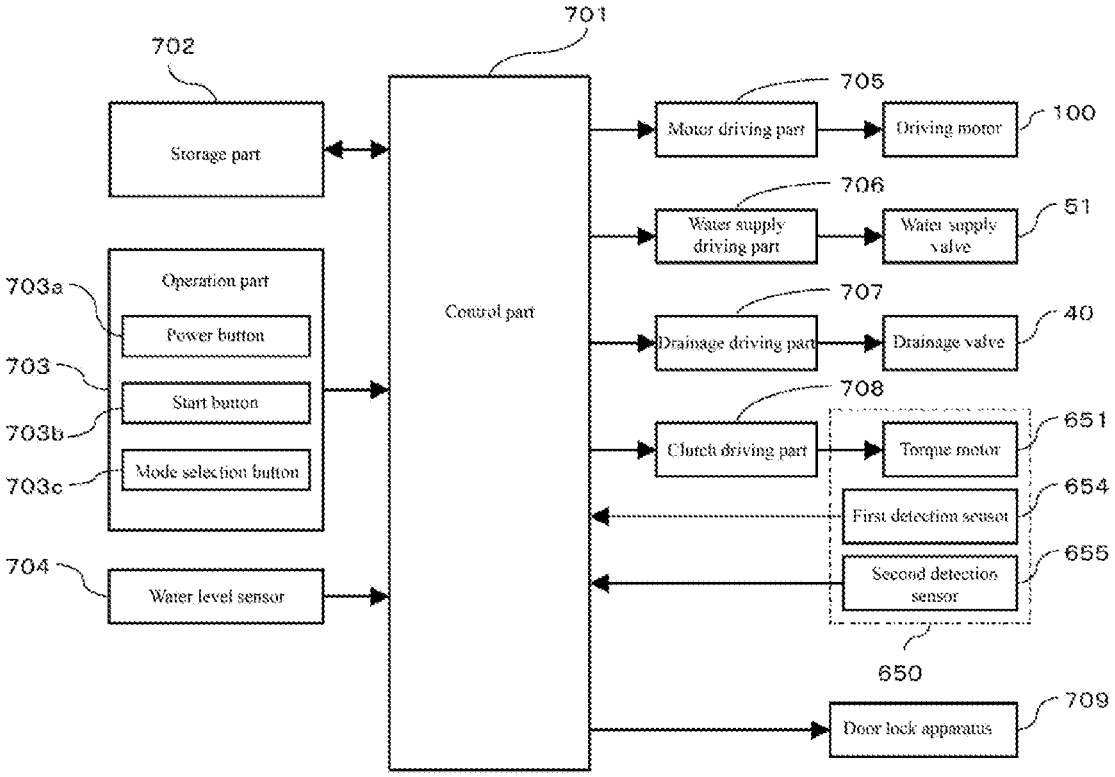
FIG. 10 is a block diagram illustrating a structure of a drum washing machine involved in an embodiment.

FIG. 10 is a block diagram illustrating a structure of a drum washing machine 1.

In addition to the above structure, the drum washing machine 1 further includes: a control part 701, a storage part 702, an operation part 703, a water level sensor 704, a motor driving part 705, a water supply driving part 706, a drainage driving part 707, a clutch driving part 708 and a door lock apparatus 709.

The operation part 703 includes: a power button 703*a*, a start button 703*b* and a mode selection button 703*c*. The power button 703*a* is a button for turning on and turning off a power supply of the drum washing machine 1. The start button 703*b* is a button for starting the operation. The mode selection button 703*c* is a button for selecting any operation mode from a plurality of operation modes for the washing operation. The operation part 703 outputs an input signal corresponding to a button operated by a user to the control part 701.

The water level sensor 704 detects a water level in the outer drum 20, and outputs a water level detection signal corresponding to the detected water level to the control part 701.

The motor driving part 705 supplies a driving current to the driving motor 100 according to a control signal from the control part 701. The motor driving part 705 includes a speed sensor for detecting the rotating speed of the driving motor 100, a frequency converter circuit and the like, and adjusts the driving current so that the driving motor 100 rotates at the rotating speed set by the control part 701. For example, PWM control is used as motor driving control. In this case, the control part 701 applies a pulse voltage of a duty ratio determined based on a detected rotating speed to the driving motor 100, so as to supply the driving current corresponding to the pulse voltage to the driving motor 100.

The water supply driving part 706 provides a driving current to the water supply valve 51 according to a control signal from the control part 701. The drainage driving part 707 provides a driving current to the drainage valve 40 according to a control signal from the control part 701.

The clutch driving apparatus 650 includes a first detection sensor 654 and a second detection sensor 655. The first detection sensor 654 detects that the driving mode of the driving unit 30 is switched to the biaxial driving mode, and outputs a detection signal to the control part 701. The second detection sensor 655 detects that the driving mode of the driving unit 30 is switched to the uniaxial driving mode, and outputs a detection signal to the control part 701. The clutch driving part 708 provides a driving current to the torque motor 651 based on the detection signals from the first detection sensor 654 and the second detection sensor 655 and the control signal outputted from the control part 701.

The door lock apparatus 709 locks and unlocks a door 12 according to a control signal from the control part 701.

The storage part 702 includes an electrically erasable programmable read only memory (EEPROM), a random access memory (RAM) and the like. The storage part 702 stores programs for executing the washing operation of various washing operation modes. In addition, the storage part 702 stores various parameters and various control marks for the execution of the programs.

The control part 701 controls the motor driving part 705, the water supply driving part 706, the drainage driving part 707, the clutch driving part 708, the door lock apparatus 709 and the like according to the programs stored in the storage part 702 based on the signals from the operation part 703, the water level sensor 704 and the like.

The drum washing machine 1 performs the washing operation of various operation modes according to the selection operation implemented by the user through the mode selection button 703*c*. The washing operation executes a washing process, an intermediate dewatering process, a rinsing process and a final dewatering process in sequence. It should be noted that the intermediate dewatering process and the rinsing process are sometimes performed more than two times depending on the operation modes.

In the washing process and the rinsing process, the driving mode of the driving unit 30 is switched to the biaxial driving mode. Water is stored in the outer drum 20 to a predetermined position which is lower than a lower edge of the laundry inlet 11 in such a manner that the laundry in the drum 22 is immersed in the water. In this state, the driving motor 100 alternately performs forward rotation and backward rotation. Thus, the drum 22 and the stirring body 24 alternately perform forward rotation and backward rotation in such a state that the rotating speed of the stirring body 24 is higher than the rotating speed of the drum 22. At this moment, the drum 22 rotates at a rotating speed through which the centrifugal force applied to the laundry is smaller than gravity.

The laundry in the drum 22 is lifted and dropped down through the baffles 23 and thrown to an inner circumferential surface of the drum 22. In addition, at the rear part of the drum 22, the laundry contacts blades 24*a* of the stirring body 24 which is rotating, and the laundry is rubbed by the blades 24*a* or stirred by the blades 24*a*. Thus, the laundry is washed or rinsed.

During washing and rinsing like this, since not only a mechanical force generated by the rotation of the drum 22 is applied to the laundry, but also a mechanical force generated by the stirring body 24 is applied to the laundry, improvement of washing performance can be expected. In the intermediate dewatering process and the final dewatering process, the driving mode of the driving unit 30 is switched to the uniaxial driving mode. The driving motor 100 (i.e., the drum 22) and the stirring body 24 rotate integrally at a rotating speed through which the centrifugal force applied to the laundry in the drum 22 is higher than the gravity. The laundry is pressed against the inner circumferential surface of the drum 22 through the effect of the centrifugal force and is dewatered.

In this way, during dewatering, since the drum 22 and the stirring body 24 rotate integrally, the laundry attached to the drum 22 does not need to be stirred by the stirring body 24 and can be well dewatered.

In the drum washing machine 1 in the present embodiment, at the end of washing and rinsing, after the control part 701 stops the driving motor 100 and stops the drum 22, the driving mode of the driving unit 30 is switched from the biaxial driving mode to the uniaxial driving mode. In addition, at the end of the intermediate dewatering, after the control part 701 stops the driving motor 100 and stops the drum 22, the driving mode of the driving unit 30 is switched from the uniaxial driving mode to the biaxial driving mode.

Figure 11:
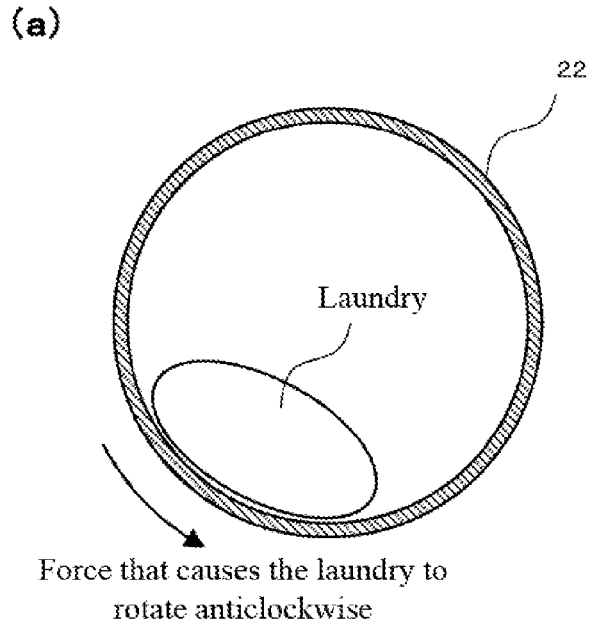
FIG. 11(*a*) is a schematic diagram illustrating a case that the laundry in a drum is biased to a left side when observed from the front side involved in an embodiment, and FIG. 11(*b*) is a schematic diagram illustrating a case that the laundry in a drum is biased to a right side when observed from the front side involved in an embodiment.
Figure 11:
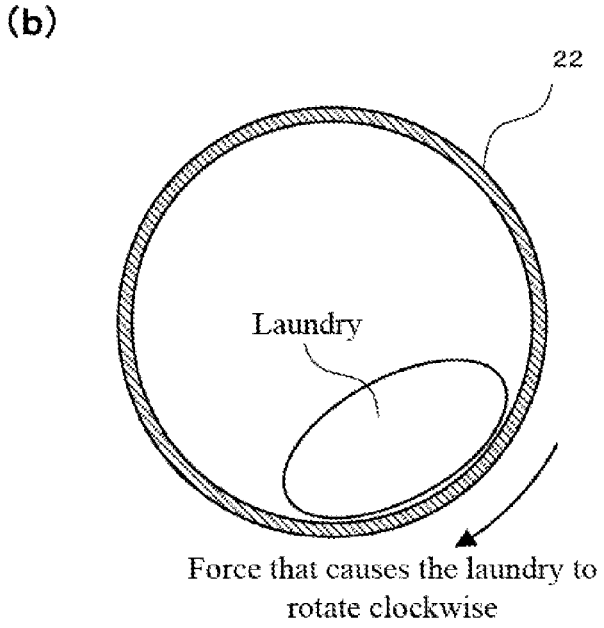

FIG. 11(*a*) is a schematic diagram illustrating a case that the laundry in the drum 22 is biased to a left side when observed from the front side, and FIG. 11(*b*) is a schematic diagram illustrating a case that the laundry in the drum is biased to a right side when observed from the front side.

Under a condition that the drum 22 is stopped, as shown in FIG. 11(*a*), when the laundry in the drum 22 is biased to the left side, a force that enables the drum 22 to rotate anticlockwise plays a role through the biased laundry. In another aspect, as shown in FIG. 11(*b*), when the laundry in the drum 22 is biased to the right side, a force that enables the drum 22 to rotate clockwise plays a role through the biased laundry.

In this way, under a condition that the laundry in the drum 22 is biased to the left side or the right side, when the driving mode is the biaxial driving mode, the teeth 611*a* of the spline 611 of the clutch body 610 and the teeth 534*a* of the spline 534 of the clutch carrying plate 530 are engaged in a state of being strongly pressed to one side, and the frictional resistance between pressed surfaces of the teeth 611*a* and 534*a* is increased. In this way, even if pushing of the clutch body 610 by the clutch lever 630 is relieved and the clutch body 610 is pushed to the rotor 110 side through the clutch spring 620 in order to switch from the biaxial driving mode to the uniaxial driving mode, the teeth 611*a* of the spline 611 and the teeth 534*a* of the spline 534 are difficult to disengage. Therefore, it is possible that switching from the biaxial driving mode to the uniaxial driving mode may not be performed smoothly.

Similarly, under a condition that the laundry in the drum 22 is biased to the left side or the right side, when the driving mode is the uniaxial driving mode, the engaging protrusion 613*b* of the engaging part 613 of the clutch body 610 and the engaging recess 132*b* of the engaged part 132 of the clutch carrying part 130 are engaged in a state of being strongly pressed to one side; and frictional resistance between pressed surfaces of the engaging protrusion 613*b* and the engaging recess 132*b* is increased. In this way, even if the clutch body 610 is pushed to the bearing unit 500 side through the clutch lever 630 in order to switch from the uniaxial driving mode to the biaxial driving mode, the engaging protrusion 613*b* and the engaging recess 132*b* are difficult to disengage. Therefore, it is possible that switching from the uniaxial driving mode to the biaxial driving mode may not be performed smoothly.

Therefore, in the present embodiment, the driving control of the clutch driving apparatus 650 and the driving motor 100 which are used for smoothly switching the driving mode of the driving unit 30 is executed by the control part 701.

Figure 12:
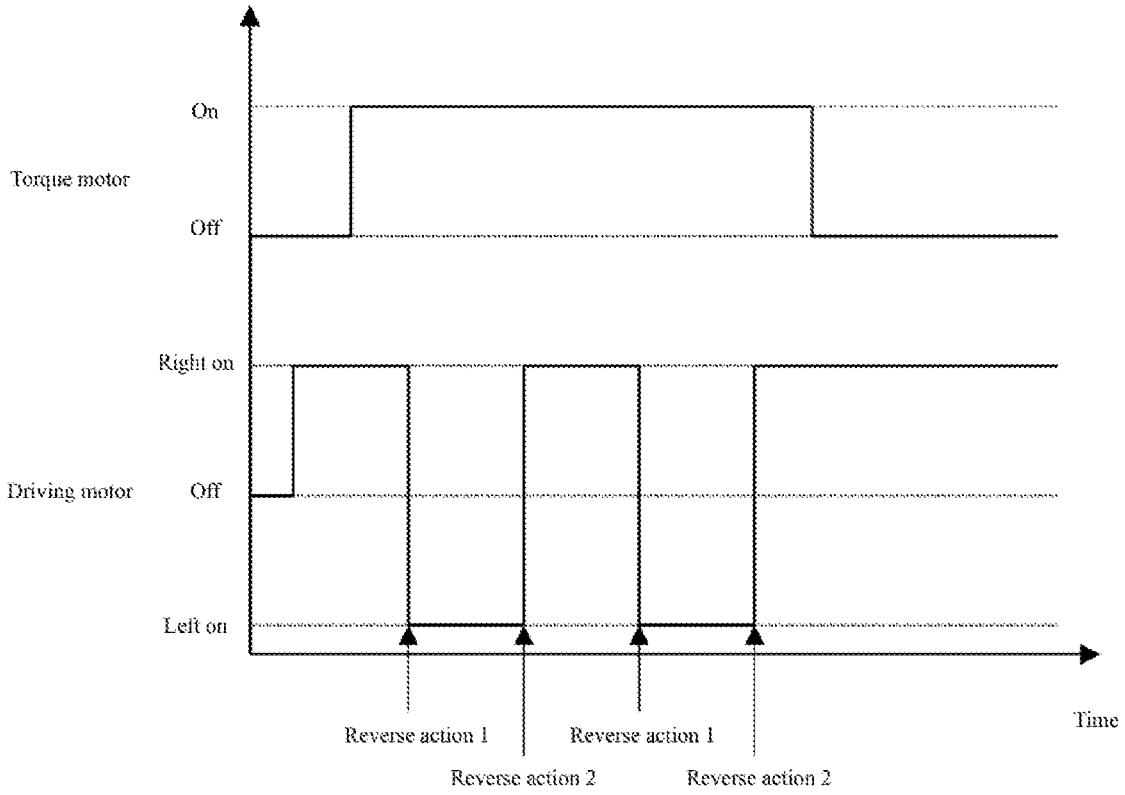
FIG. 12 is a timing diagram illustrating an energizing action of a torque motor and a driving motor of a clutch driving apparatus while switching driving modes of a drive unit involved in an embodiment.

FIG. 12 is a timing diagram illustrating an energizing action of the torque motor 651 and the driving motor 100 of the clutch driving apparatus 650 while switching the driving mode of the drive unit 30.

In both of switching from the uniaxial driving mode to the biaxial driving mode and switching from the biaxial driving mode to the uniaxial driving mode, as shown in FIG. 12, the control part 701 energizes the driving motor 100 in a right rotation manner and rotates the rotor 110 clockwise, and then the driving motor 100 is deenergized. Thereafter, after the control part 701 immediately energizes the driving motor 100 in a left rotation manner without interposing the stopping period and rotates the rotor 110 anticlockwise, the driving motor 100 is deenergized. Then, further, after the control part 701 immediately energizes the driving motor 100 in a right rotation manner without interposing a stopping period and rotates the rotor 110 clockwise, the driving motor 100 is deenergized. Then, after the control part 701 immediately energizes the driving motor 100 in a left rotation manner without interposing a stopping period and rotates the rotor 110 anticlockwise, the driving motor 100 is deenergized. Finally, the control part 701 immediately energizes the driving motor 100 in a right rotation manner without interposing a stopping period. Then, in order to conduct washing, rinsing, dewatering and the like after the driving mode is switched, the driving motor 100 is continuously energized and the rotor 110 continuously rotates.

During energizing-deenergizing actions of the driving motor 100, the control part 701 enables the torque motor 651 to operate. Namely, as shown in FIG. 12, after the control part 701 energizes the driving motor 100 in the right rotation manner initially until the driving motor 100 is deenergized, the torque motor 651 is energized. Then, the control part 701 deenergizes the torque motor 651 according to the detection of the first detection sensor 654 when switching from the uniaxial driving mode to the biaxial driving mode, and deenergizes the torque motor 651 according to the detection of the first detection sensor 654 when switching from the biaxial driving mode to the uniaxial driving mode. However, in either case, the torque motor 651 is deenergized after the driving motor 100 is finally energized in the right rotation manner.

The driving motor 100 and the torque motor 651 are operated through such timing, so that a reverse action 1 and a reverse action 2 are respectively repeated twice during the operation of the torque motor 651 (i.e., during a movement action of the clutch body 610 performed through the moving mechanism part DM). The reverse action 1 is an action of stopping the rotor 110 that is rotating in the clockwise direction and then immediately enabling the rotor 110 to rotate along the anticlockwise direction, and the reverse action 2 is an action of stopping the rotor 110 that is rotating in the anticlockwise direction and then immediately enabling the rotor 110 to rotate along the clockwise direction.

As shown in FIG. 11(*a*), in a condition that the laundry in the drum 22 is biased to the left side when the drum 22 is stopped, if the rotor 110 of the driving motor 100 rotates in the clockwise direction, the drum 22 rotates in the clockwise direction opposed to the direction of the force that acts on the biased laundry. Then, when the driving motor 100 is stopped, since an inertia force for continuing to rotate in the clockwise direction acts on the drum 22 at this moment, the force that acts on the biased laundry is offset by the inertia force and is weakened. In this way, when switching from the biaxial driving mode to the uniaxial driving mode, since the force by which the teeth 611*a* of the spline 611 of the clutch body 610 and the teeth 534*a* of the spline 534 of the clutch carrying plate 530 are pressed towards one side is weakened, the teeth 611*a* of the spline 611 becomes easy to separate from the teeth 534*a* of the spline 534. In addition, when switching from the uniaxial driving mode to the biaxial driving mode, since the force by which the engaging protrusion 613*b* of the engaging part 613 of the clutch body 610 and the engaging recess 132*b* of the engaged part 132 of the clutch carrying part 130 are pressed towards one side is weakened, the engaging protrusion 613*b* of the engaging part 613 becomes easy to separate from the engaging recess 132*b* of the engaged part 132.

In addition, the rotor 110 of the driving motor 100 immediately rotates in the anticlockwise direction after stopping, and then the spline 611 and the engaged part 132 are about to rotate in a direction weakening the force that presses the teeth 611*a* and the teeth 534*a* as well as the engaging protrusion 613*b* and the engaging recess 132*b* towards one side. Therefore, the spline 611 and the spline 534 and the engaging part 613 and the engaged part 132 are more difficult to disengage.

In this way, even if the laundry in the drum 22 is biased to the left side when the drum 22 is stopped, two reverse actions 1 are performed during the operation period of the torque motor 651, so that the spline 611 and the spline 534 are easy to disengage and the engaging part 613 and the engaged part 132 are also easy to disengage. Similarly, as shown in FIG. 11(*b*), even if the laundry in the drum 22 is biased to the right side when the drum 22 is stopped, two reverse actions 2 are performed during the operation period of the torque motor 651 and the same phenomenon as the two reverse actions 1 occurs, so that the spline 611 and the spline 534 are easy to disengage and the engaging part 613 and the engaged part 132 are also easy to disengage. Thus, switching from the biaxial driving mode to the uniaxial driving mode can be conducted smoothly, and switching from the uniaxial driving mode to the biaxial driving mode can be conducted smoothly.

As mentioned above, according to the present embodiment, even if the clutch body 610 moves to the clutch carrying plate 530 side in order to switch to the biaxial driving mode, the teeth 611*a* and 534*a* of the splines 611 and 534 are abutted with each other rather than engaged with each other, and then, positions of the teeth 611*a* and 534*a* are staggered through the rotation of the driving motor 100 and the clutch body 610 rapidly moves to the clutch carrying plate 530 side, so that the teeth 611*a* and 534*a* are mutually engaged. Even in such case, since the bearing-side cushioning member 540 provided on the clutch carrying plate 530 side firstly contacts the front end part of the clutch body 610, the impact force to the clutch carrying plate 530 side of the clutch body 610 is also weakened by the bearing-side cushioning member 540. Thus, an impact sound generated between the clutch body 610 side and the clutch carrying plate 530 side is reduced.

In addition, according to the present embodiment, the bearing-side cushioning member 540 is sandwiched by the bearing part 510 and the clutch carrying plate 530 through the flange part 541 and is fixed to the clutch carrying plate 530 side. Therefore, the bearing-side cushioning member 540 is easily fixed to the clutch carrying plate 530 side without using a screw and the like.

Further, according to the present embodiment, even if the clutch body 610 moves to the clutch carrying part 130 side in order to switch to the uniaxial driving mode, the engaging protrusion 613*b* is not engaged with the engaging recess 132*b* but is abutted against the surface 132*a* of the engaged part 132, and then, the positions of the engaging protrusion 613*b* and the engaging recess 132*b* are coincided through the rotation of the driving motor 100, the clutch body 610 rapidly moves to the clutch carrying part 130 side and the engaging protrusion 613*b* and the engaging recess 132*b* are engaged. Even in such case, since the rotor-side cushioning member 680 provided on the clutch body 610 side firstly contacts the touch surface 133 of the clutch carrying part 130 side, the impact force to the clutch carrying part 130 side of the clutch body 610 is also weakened by the rotor-side cushioning member 680. Thus, an impact sound generated between the clutch body 610 side and the clutch carrying part 130 side is reduced.

Further, according to the present embodiment, the claw part 681 of the rotor-side cushioning member 680 is locked to the hole part 614 formed in the clutch body 610 so that the rotor-side cushioning member 680 is fixed to the clutch body 610 side. Therefore, the rotor-side cushioning member 680 is easily fixed to the clutch body 610 side without using a screw and the like.

Further, according to the present embodiment, in both switching from the uniaxial driving mode to the biaxial driving mode and switching from the biaxial driving mode to the uniaxial driving mode, the rotor 110 of the driving motor 100 rotates clockwise and anticlockwise respectively, so as to respectively execute an action of enabling the rotor 110 rotating along the clockwise direction to stop, and an action of enabling the rotor 110 rotating along the anticlockwise direction to stop when the clutch body 610 moves through the moving mechanism part DM. Thus, even if the laundry in the drum 22 is biased to either the left side or the right side when the drum 22 is stopped, when switching from the uniaxial driving mode to the biaxial driving mode, the engaging part 613 of the clutch body 610 and the engaged part 132 of the clutch carrying part 130 are easy to disengage, and when switching from the biaxial driving mode to the uniaxial driving mode, the spline 611 of the clutch body 610 and the spline 534 of the clutch carrying plate 530 are also easy to disengage. Therefore, with the present embodiment, the switching of the driving mode between the uniaxial driving mode and the biaxial driving mode can be conducted smoothly.

In addition, under a condition that the torque motor 651 is operated in a state in which it is difficult to disengage, a load applied to the torque motor 651 may be increased. According to the present embodiment, the load applied to the torque motor 651 can be prevented from increasing.

Further, in the case of switching from the uniaxial driving mode to the biaxial driving mode, the clutch lever 630 does not move unless the engaging part 613 and the engaged part 132 are disengaged, so that the operation of the torque motor 651 is ended only when the spring 661 of the relay rod 660 is in an elongated state. After that, when the driving motor 100 rotates for washing and the like, since the force used to press the engaging protrusion 613*b* and the engaging recess 132*b* towards one side is weakened, the engaging protrusion 613*b* and the engaging recess 132*b* are easy to disengage. In this case, the following hidden dangers exist: the spring 661 rapidly contracts while the clutch lever 630 vigorously moves, the clutch body 610 is vigorously pushed by the clutch lever 630 and is fiercely collided with the clutch carrying plate 530, thereby generating a large impact sound. In addition, in the case of switching from the biaxial driving mode to the uniaxial driving mode, when the spline 611 and the spline 534 are not disengaged, only the clutch lever 630 moves through the action of the torque motor 651 when the clutch spring 620 contracts. After that, when the operation of the torque motor 651 is ended, the driving motor 100 rotates for washing and the like, the spline 611 and the spline 534 are easy to disengage, the following hidden dangers exist: the clutch spring 620 is rapidly elongated; the clutch body 610 is vigorously pushed by the clutch spring 620 and is fiercely collided with the clutch carrying part 130, thereby generating a large impact sound. According to the present embodiment, since the spline 611 and the spline 534 can be disengaged smoothly, and the engaging part 613 and the engaged part 132 can be disengaged smoothly, the large impact sound can be avoided between the clutch body 610 and the clutch carrying plate 530 and between the clutch body 610 and the clutch carrying part 130.

Further, according to the present embodiment, after the rotor 110 of the driving motor 100 is stopped from rotating in a direction, the rotor 110 immediately rotates in an opposite direction without interposing the stopping period, so the force used to press the teeth 611*a* of the spline 611 and the teeth 534*a* of the spline 534 as well as the engaging protrusion 613*b* of the engaging part 613 and the engaging recess 132*b* of the engaged part 132 towards one side can be further weakened, and the spline 611 and the spline 534 as well as the engaging part 613 and the engaged part 132 become easier to disengage.

Further, according to the present embodiment, since the torque motor 651 starts to operate (i.e., the moving action of the clutch body 610 of the moving mechanism part DM is started) after the rotor 110 of the driving motor 100 initially starts to rotate along the clockwise direction, an action of stopping the rotation of the rotor 110 along the clockwise direction is rapidly conducted after the moving action of the clutch body 610 is started, such that the spline 611 and the spline 534 as well as the engaging part 613 and the engaged part 132 become easier to disengage.

Although embodiments of the present disclosure are described above, the present disclosure is not limited to the above-mentioned embodiments. In addition, various modification other than the above can also be made to embodiments of the present disclosure.

For example, in above embodiments, in order to reduce the impact sound between the clutch body 610 side and the clutch carrying plate 530 side, the bearing-side cushioning member 540 is placed on the clutch carrying plate 530 side. However, as shown in FIG. 11 and FIG. 12, a bearing-side cushioning member 690 can also be placed on the clutch body 610 side to replace the bearing-side cushioning member 540.

Figure 13:
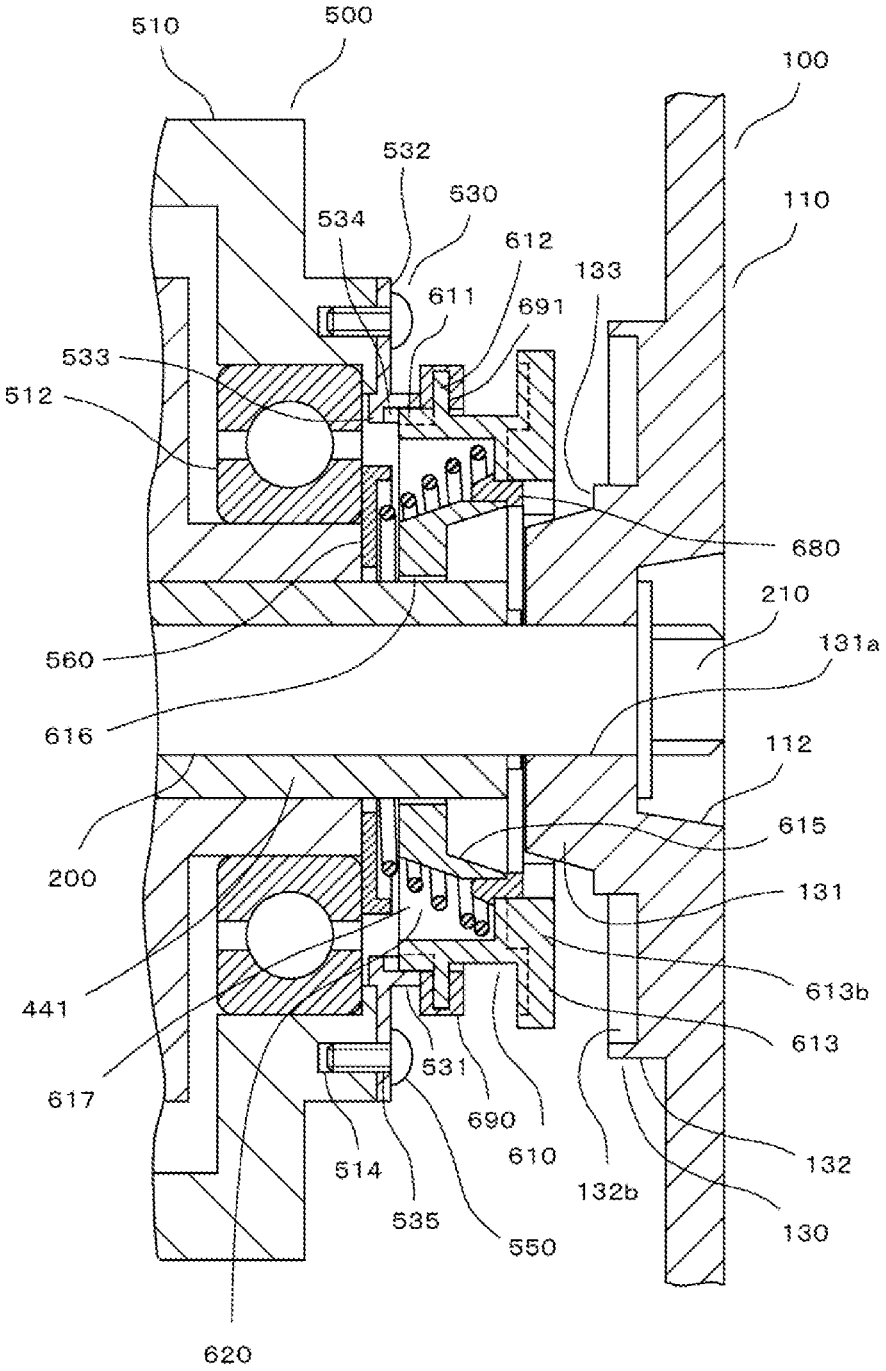
FIG. 13 is a sectional view illustrating an essential part enlarging a periphery of a clutch body involved in a modified embodiment.
Figure 14:
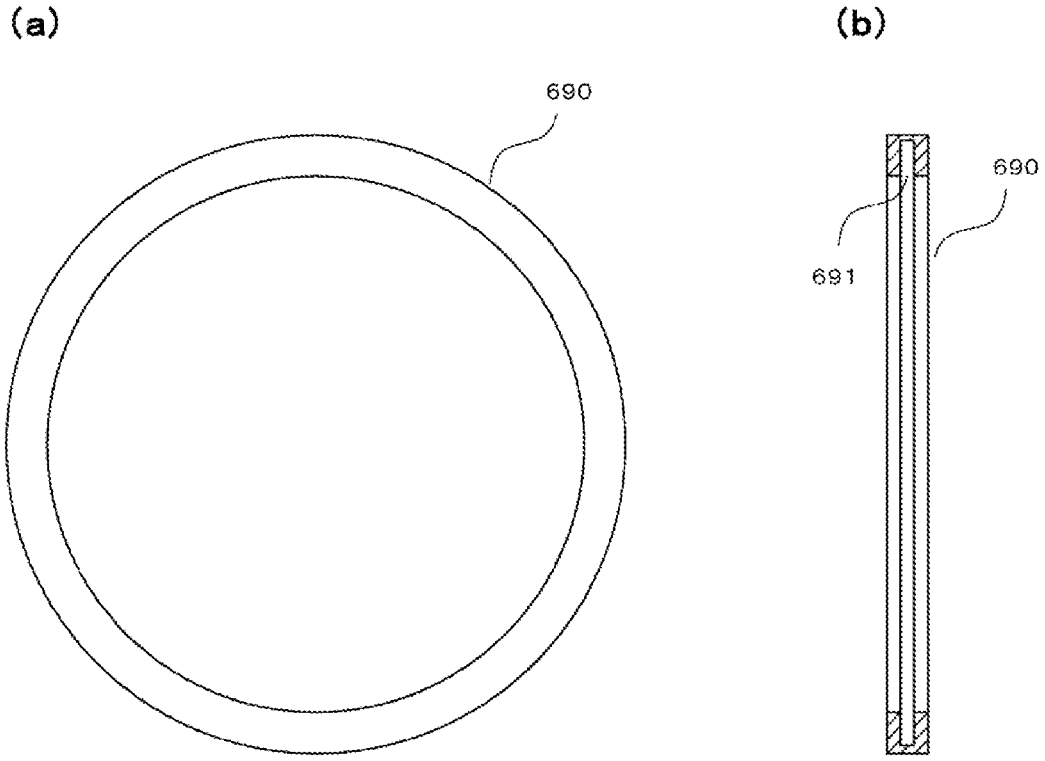
FIG. 14(*a*) and FIG. 14(*b*) are respectively a front view and a side sectional view illustrating a bearing-side cushioning member involved in a modified embodiment.

FIG. 13 is a sectional view illustrating an essential part enlarging a periphery of a clutch body 610 according to a modified embodiment. FIG. 14(*a*) and FIG. 14(*b*) are respectively a front view and a side sectional view illustrating a bearing-side cushioning member 690 involved in a modified embodiment.

The bearing-side cushioning member 690 is formed into a circular shape by rubber and other elastic members. cushioning member An annular groove part 691 is formed in the center of the bearing-side cushioning member 690. The bearing-side cushioning member 690 is fixed to the clutch body 610 by embedding the groove part 691 into the flange part 612 of the clutch body 610.

As shown in FIG. 13, when the spline 611 of the clutch body 610 is engaged with the spline 534 of the clutch carrying plate 530, the bearing-side cushioning member 690 firstly hits the clutch carrying plate 530. Thus, the impact sound between the clutch body 610 side and the clutch carrying plate 530 side can be reduced.

In addition, in above embodiments, in order to reduce the impact sound between the clutch body 610 side and the clutch carrying part 130 side, the rotor-side cushioning member 680 is provided on the clutch body 610 side. However, as shown in FIG. 15, instead of the rotor-side cushioning member 680, a rotor-side cushioning member 140 may be provided on the clutch carrying part 130 sidecushioning member.

Figure 15:
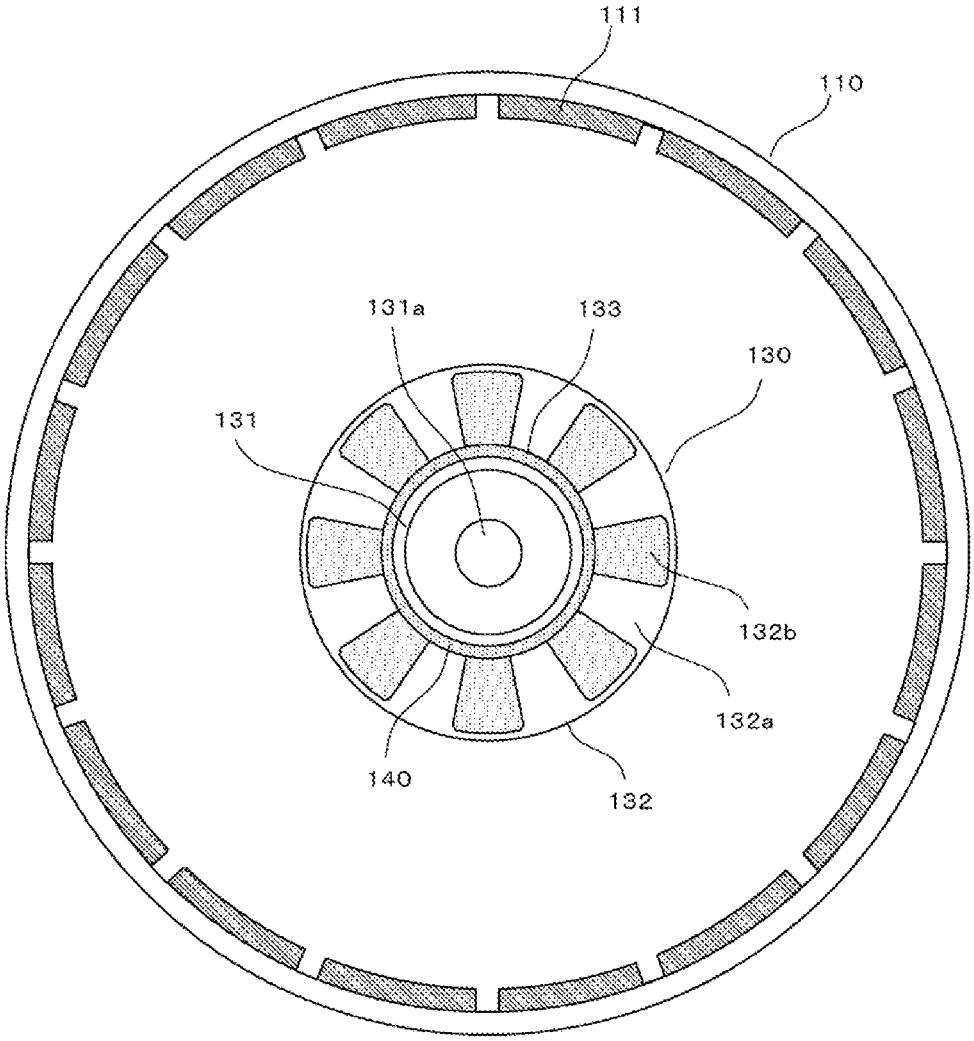
FIG. 15 is a front view illustrating a rotor of a driving motor involved in a modified embodiment.

FIG. 15 is a front view illustrating a rotor 110 of a driving motor 100 involved in a modified embodiment. The rotor-side cushioning member 140 is formed into an annular shape by elastic member such as rubber, and is fixed by attaching to the touch surface 133 of the clutch carrying part 130 side and other fixation methods. When the engaging part 613 of the clutch body 610 and the engaged part 132 of the clutch carrying part 130 are engaged, the rotor-side cushioning member 140 firstly hits the clutch body 610. Thus, the impact sound between the clutch body 610 side and the clutch carrying part 130 side can be reduced.

Figure 16:
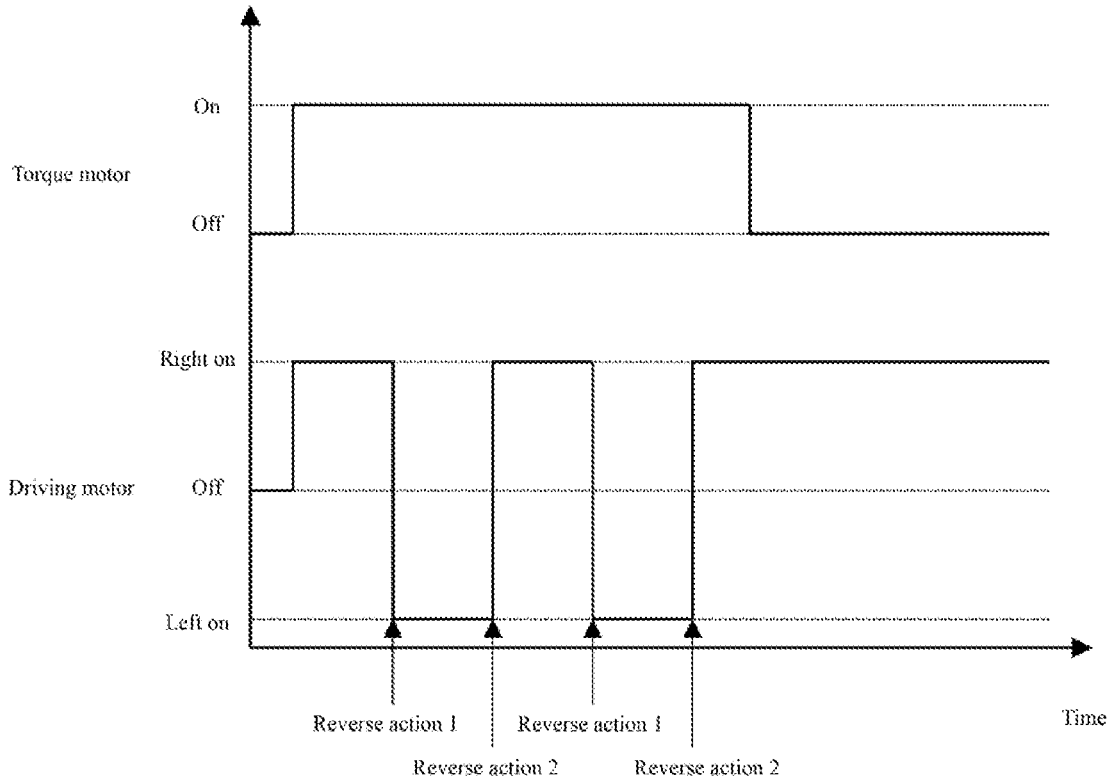
FIG. 16 is a timing diagram illustrating an energizing action of a torque motor and a driving motor of a clutch driving apparatus while switching driving modes of a drive unit involved in a modified embodiment.

Further, in above embodiments, as shown in FIG. 12, after the control part 701 energizes the driving motor 100 in the right rotation manner initially until the driving motor 100 is deenergized, the torque motor 651 is energized. Namely, after the rotor 110 of the driving motor 100 initially starts to rotate along the clockwise direction, the moving action of the clutch body 610 is started by the moving mechanism part DM. However, as shown in the timing diagram of FIG. 16, the control part 701 can also energize the torque motor 651 almost at the same time of initial energization of the driving motor 100 in the right rotation manner. Namely, the moving action of the clutch body 610 can be started through the moving mechanism part DM almost at the same time that the rotor 110 of the driving motor 100 initially starts to rotate along the clockwise direction.

Further, in above embodiments, after the rotor 110 of the driving motor 100 is stopped from rotating along one direction, the rotor 110 immediately rotates along an opposed direction without interposing a stopping period.

However, after the rotor 110 of the driving motor 100 is stopped from rotating along one direction, the rotor 110 is stopped for a stopping period and then rotates along an opposed direction.

Further, in above embodiments, although the rotor 110 of the driving motor 100 firstly rotates clockwise, the rotor 110 may firstly rotate anticlockwise.

Figure 17:
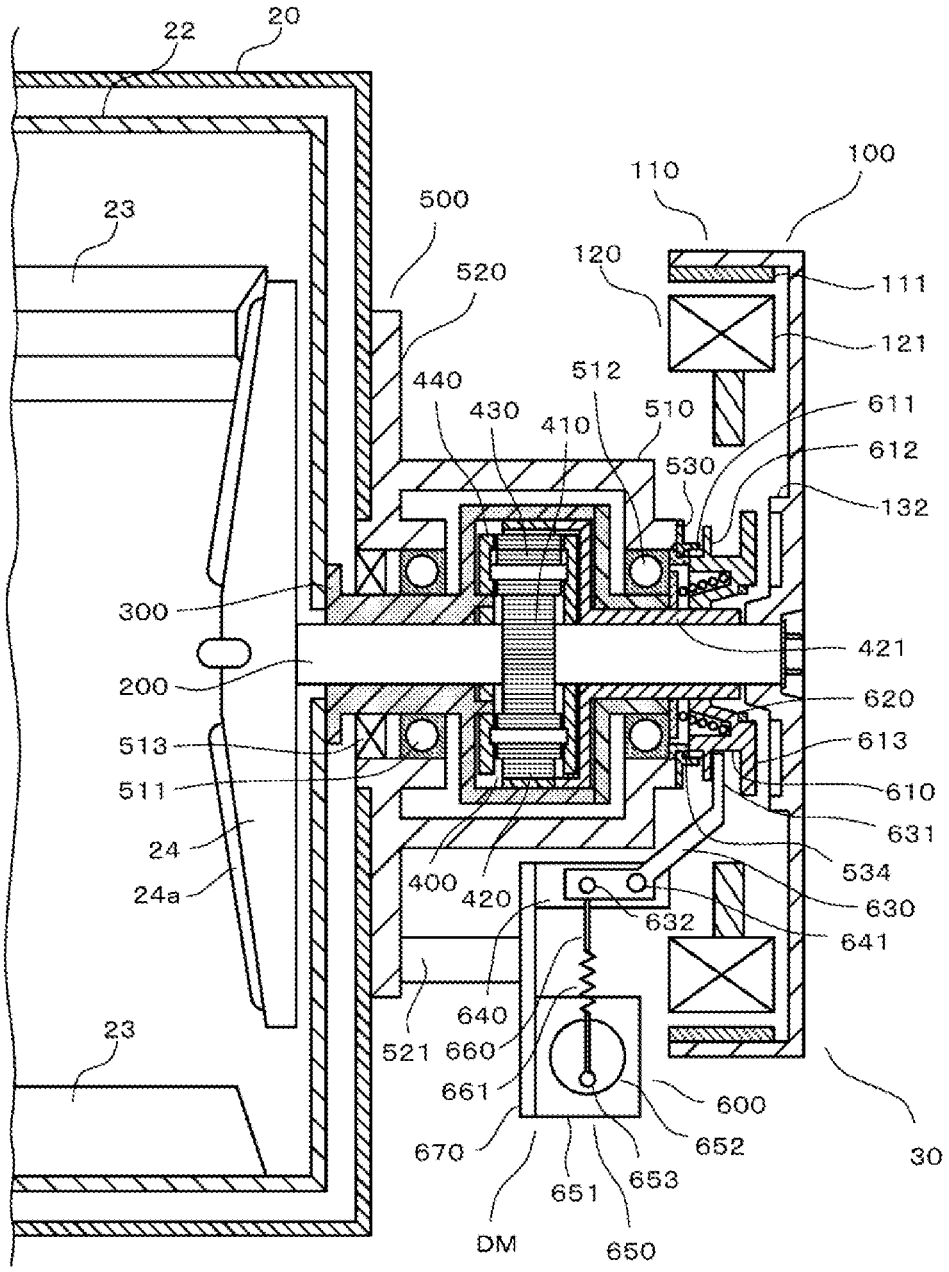
FIG. 17 is a sectional view illustrating a drive unit involved in a modified embodiment.

Further, in above embodiments, the drum shaft 300 is fixed to the internal gear 420, and the clutch body 610 is connected with the planetary carrier shaft 441 (i.e., the planetary carrier 440). Thus, in the biaxial driving mode, when the wing shaft 200 rotates in such a state that the planetary carrier 440 is fixed by the clutch body 610, the planetary gear 430 rotates along with the rotation of the sun gear 410 and the internal gear 420 rotates at a rotating speed lower than the rotating speed of the sun gear 410. However, as shown in FIG. 17, a structure in which the drum shaft 300 is fixed to the planetary carrier 440 can also be adopted. In this case, a shaft part 421 with a top end part protruding rearward from the drum shaft 300 is installed on the internal gear 420. Moreover, the clutch body 610 is connected with the shaft part 421. Namely, the clutch body 610 is connected with the internal gear 420 via the shaft part 421. Furthermore, the planetary gear 430 is modified to have only a first gear. In the biaxial driving mode, when the wing shaft 200 rotates in such a state that the internal carrier 420 is fixed by the clutch body 610, the planetary gear 430 rotates and revolves along with the rotation of the sun gear 410 and the planetary carrier 440 rotates at a rotating speed lower than the rotating speed of the sun gear 410. Thus, the drum shaft 300 fixed to the planetary carrier 440 rotates.

Furthermore, in above embodiments, the rotor 110 of the driving motor 100 is directly coupled with the stirring body 24 through the wing shaft 200, and the stirring body 24 rotates at a rotating speed equal to the rotating speed of the driving motor 100. However, a speed reducing mechanism that uses a gear can also be interposed, like the drum 22, between the stirring body 24 and the driving motor 100. In this case, the stirring body 24 can rotate more rapidly than the drum 22 by making a speed reducing ratio of the speed reducing mechanism of the stirring body 24 is smaller than a speed reducing ratio of the planetary gear mechanism 400.

Furthermore, in above embodiments, the drum 22 rotates about an inclined axis inclined relative to a horizontal direction. However, the drum washing machine 1 can also adopt a structure in which the drum 22 rotates about a horizontal axis.

Further, although the drum washing machine 1 in above embodiments does not have a drying function, the present disclosure can also be applied to a drum washing machine having the drying function, i.e., a drum washing and drying machine.

In addition, various changes can be properly made to embodiments of the present disclosure within a scope of the technical idea shown in the technical solution.

LIST OF REFERENCE NUMERALS

10: housing;
20: outer drum;
22: drum;
24: stirring body (rotating body);
24*a*: blade (protruding part);
30: driving unit (driving part);
100: driving motor;
110: rotor;
130: clutch carrying part;
132: engaged part (second engaged part);
140: rotor-side cushioning member (rotating part-side cushioning member);
200: wing shaft (first rotating shaft);
300: drum shaft (second rotating shaft);
400: planetary gear mechanism;
410: sun gear;
420: internal gear;
430: planetary gear;
440: planetary carrier;
510: bearing part;
530: clutch carrying plate (fixing part);
534: spline (first engaged part);
540: bearing-side cushioning member (fixing part-side cushioning member);
541: flange part;
600: clutch mechanism part;
610: clutch body;
611: spline (first engaging part);
613: engaging part (second engaging part);
614: hole part;
680: rotor-side cushioning member (rotating part-side cushioning member);
681: claw part;
690: bearing-side cushioning member (fixing part-side cushioning member); and
DM: moving mechanism part.

What is claimed is:

1. A drum washing machine, comprising:
an outer drum arranged in a housing;
a drum arranged in the outer drum and rotatable about a horizontal axis or an inclined axis inclined with respect to a horizontal direction;
a rotating body arranged in a rear part of the drum, wherein a surface of the rotating body is provided with a baffle for contacting laundry; and
a driving part configured to rotate the drum and the rotating body,
wherein the driving part comprises:
a driving motor;
a first rotating shaft configured to transmit rotation of the driving motor to the rotating body;
a second rotating shaft coaxially arranged with the first rotating shaft and configured to transmit the rotation of the driving motor to the drum;
a planetary gear mechanism, comprising a sun gear rotating along with the rotation of the driving motor, an annular internal gear surrounding the sun gear, a plurality of planetary gears interposed between the sun gear and the internal gear, and a planetary carrier free rotatably holding the plurality of planetary gears, wherein one of the planetary carrier and the internal gear is fixed to the second rotating shaft; and
a clutch mechanism part, configured to switch a driving mode of the driving part between a first mode and a second mode, wherein the first mode is a driving mode in which the first rotating shaft and the second rotating shaft independently rotate, and the second mode is a driving mode in which the first rotating shaft and the second rotating shaft integrally rotate;
the clutch mechanism part comprises:
a clutch body, connected to the other one of the planetary carrier and the internal gear in such a state that the clutch body is rotatable together with the other one of the planetary carrier and the internal gear and is moveable towards an axis direction of the second rotating shaft; a moving mechanism part, configured to enable the clutch body to move to a first position when switching to the first mode, and enable the clutch body to move to a second position when switching to the second mode;

a first engaging part with a concave-convex shape and a second engaging part with a concave-convex shape formed in the clutch body;

a first engaged part formed in a fixing part which does not rotate along with the driving motor, wherein the first engaged part has a concave-convex shape corresponding to the concave-convex shape of the first engaging part and is engaged with the first engaging part along a circumferential direction when the clutch body moves to the first position;

a second engaged part formed in a rotating part which rotates along with the driving motor, wherein the second engaged part has a concave-convex shape corresponding to the concave-convex shape of the second engaging part and is engaged with the second engaging part along the circumferential direction when the clutch body moves to the second position; and a fixing part-side cushioning member is arranged on the clutch body side or the fixing part side, wherein the fixing part-side cushioning member firstly touches an object side when the first engaging part and the first engaged part are engaged, so as to reduce an impact force generated between the clutch body and the fixing part;

the driving part further comprises a bearing part that free rotatably supports the second rotating shaft;

a first rolling bearing and a second rolling bearing are arranged on a front portion and a rear portion of the bearing part, respectively; and an outer circumferential surface of the second rotating shaft is carried by the first rolling bearing and the second rolling bearing, and rotates smoothly in the bearing part;

the fixing part is mounted on the bearing part; the fixing part comprises a carrying body part and a pressing part; the carrying body part is formed in a flat cylindrical shape, and has the first engaged part on an inner side surface; the pressing part is protruded from the carrying body part to the second rolling bearing, and has a circular shape; and the fixing part-side cushioning member is arranged on the fixing part side, and has a flange part sandwiched by the fixing part and the bearing part; wherein the flange part is sandwiched between the second rolling bearing of the bearing part and the pressing part of the fixing part, and is pressed to the second rolling bearing side by the pressing part; an outer circumferential edge of the flange part is provided with an annular protruding part, and the protruding part is in contact with an outer circumferential surface of the pressing part.

2. The drum washing machine according to claim 1, wherein a rotating part-side cushioning member is arranged on the clutch body side or the rotating part side, and the rotating part-side cushioning member firstly touches the object side when the second engaging part and the second engaged part are engaged, so as to reduce an impact force generated between the clutch body and the rotating part.

3. The drum washing machine according to claim 2, wherein the rotating part-side cushioning member is arranged on the clutch body side, and has a claw part; and the clutch body has a hole part for inserting and locking the claw part.

4. A drum washing machine, comprising:

an outer drum arranged in a housing;

a drum arranged in the outer drum and is rotatable about a horizontal axis or an inclined axis inclined with respect to a horizontal direction;

a rotating body arranged in a rear part of the drum, wherein a surface of the rotating body is provided with a baffle for contacting laundry; and a driving part configured to rotate the drum and the rotating body, wherein the driving part comprises:

a driving motor;

a first rotating shaft configured to transmit rotation of the driving motor to the rotating body;

a second rotating shaft coaxially arranged with the first rotating shaft and configured to transmit the rotation of the driving motor to the drum;

a planetary gear mechanism, comprising a sun gear rotating along with the rotation of the driving motor, an annular internal gear surrounding the sun gear, a plurality of planetary gears interposed between the sun gear and the internal gear, and a planetary carrier free rotatably holding the plurality of planetary gears, wherein one of the planetary carrier and the internal gear is fixed to the second rotating shaft; and a clutch mechanism part, configured to switch a driving mode of the driving part between a first mode and a second mode, wherein the first mode is a driving mode in which the first rotating shaft and the second rotating shaft independently rotate, and the second mode is a driving mode in which the first rotating shaft and the second rotating shaft integrally rotate;

wherein the clutch mechanism part comprises:

a clutch body, connected to the other one of the planetary carrier and the internal gear in such a state that the clutch body is rotatable together with the other one of the planetary carrier and the internal gear and is moveable towards an axis direction of the second rotating shaft;

a moving mechanism part, configured to enable the clutch body to move to a first position when switching to the first mode, and enable the clutch body to move to a second position when switching to the second mode;

a first engaging part with a concave-convex shape and a second engaging part with a concave-convex shape which are formed in the clutch body;

a first engaged part which is formed in a fixing part that does not rotate along with the driving motor, wherein the first engaged part has a concave-convex shape corresponding to the concave-convex shape of the first engaging part and is engaged with the first engaging part along a circumferential direction when the clutch body moves to the first position;

a second engaged part which is formed in a rotating part that rotates along with the driving motor, wherein the second engaged part has a concave-convex shape corresponding to the concave-convex shape of the second engaging part and is engaged with the second engaging part along the circumferential direction when the clutch body moves to the second position; and a rotating part-side cushioning member arranged on the clutch body side or the rotating part side, wherein the rotating part-side cushioning member firstly touches an object side when the second engaging part and the second engaged part are engaged, so as to reduce an impact force generated between the clutch body and the rotating part;

the driving part further comprises a bearing part that free rotatably supports the second rotating shaft;

a first rolling bearing and a second rolling bearing are arranged on a front portion and a rear portion of the bearing part, respectively; and an outer circumferential surface of the second rotating shaft is carried by the first rolling bearing and the second rolling bearing, and rotates smoothly in the bearing part;

the fixing part is mounted on the bearing part; the fixing part comprises a carrying body part and a pressing part; the carrying body part is formed in a flat cylindrical shape, and has the first engaged part on an inner side surface; the pressing part is protruded from the carrying body part to the second rolling bearing, and has a circular shape; and a fixing part-side cushioning member is arranged on the fixing part side, and has a flange part sandwiched by the fixing part and the bearing part; wherein the flange part is sandwiched between the second rolling bearing of the bearing part and the pressing part of the fixing part, and is pressed to the second rolling bearing side by the pressing part; an outer circumferential edge of the flange part is provided with an annular protruding part, and the protruding part is in contact with an outer circumferential surface of the pressing part.

* * * * *